US012760461B2

(12) United States Patent
Saier

(10) Patent No.: US 12,760,461 B2
(45) Date of Patent: Oct. 13, 2026

(54) DOSING APPARATUS

(71) Applicant: HERBERT SAIER GMBH, Gundelfingen (DE)

(72) Inventor: Michael Saier, Freiburg (DE)

(73) Assignee: HERBERT SAIER GMBH, Gundelfingen (DE)

( * ) Notice: Subject to any disclaimer, the term of this patent is extended or adjusted under 35 U.S.C. 154(b) by 456 days.

(21) Appl. No.: 17/957,296

(22) Filed: Sep. 30, 2022

(65) Prior Publication Data

US 2023/0116564 A1 Apr. 13, 2023

(30) Foreign Application Priority Data

Oct. 7, 2021 (DE) ..... 10 2021 126 058.2
Jul. 1, 2022 (DE) ..... 10 2022 116 545.0

(51) Int. Cl.

| | |
|---|---|
| ***D06F 33/37*** | (2020.01) |
| ***A47L 15/00*** | (2006.01) |
| ***A47L 15/44*** | (2006.01) |
| ***D06F 34/05*** | (2020.01) |
| ***D06F 34/14*** | (2020.01) |
| ***D06F 39/02*** | (2006.01) |
| ***D06F 103/00*** | (2020.01) |

(Continued)

(52) U.S. Cl.

CPC ..... *D06F 33/37* (2020.02); *D06F 39/022* (2013.01); *A47L 15/0055* (2013.01);

(Continued)

(58) Field of Classification Search

CPC .... D06F 33/37; D06F 39/022; D06F 2103/16; D06F 2103/52; D06F 34/05; D06F 34/14;

(Continued)

(56) References Cited

U.S. PATENT DOCUMENTS 4,483,200 A 11/1984 Togawa
5,014,211 A * 5/1991 Turner ..... D06F 39/022 700/265

(Continued)

FOREIGN PATENT DOCUMENTS

CN 102893134 B 5/2016
DE 3237785 C2 * 6/1987 ..... F04B 43/1292

(Continued)

OTHER PUBLICATIONS

DE3237785 translation (Year: 1987).*
German Office Action Dated Jun. 6, 2023, 10 Pages.

*Primary Examiner* — Michael E Barr
*Assistant Examiner* — Lauren G Orta
(74) *Attorney, Agent, or Firm* — LUCAS & MERCANTI, LLP; Klaus P. Stoffel

(57) ABSTRACT

A metering device for metering and supplying media via a fluid line to at least one target apparatus, in particular to an industrial textile washing machine, wherein the metering device is connected to at least one container which is filled with a medium. The metering device has a control unit which, in order to carry out a metering process with the aid of at least one pump, causes a specific volume of medium to be removed from the container and a conveyance of this volume towards the target apparatus. The fluid line has at least one heating element and at least one temperature sensor connected to a measuring device, wherein, by way of the measuring device, with the aid of a measurement value output by the temperature sensor, information about a performed conveyance of the medium through the fluid line can be determined and transmitted to the control unit.

18 Claims, 15 Drawing Sheets

Figure 1:
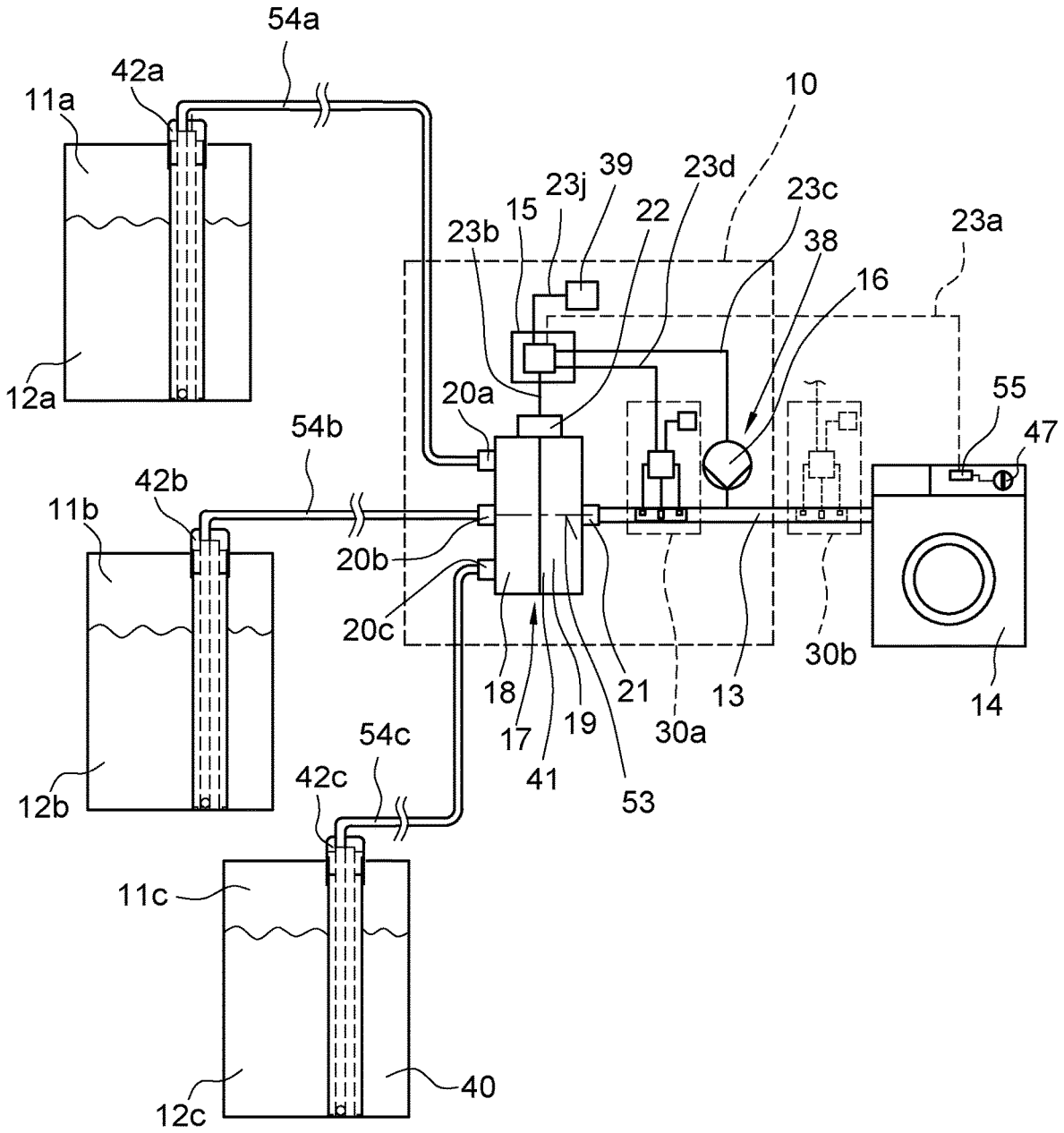

(51) Int. Cl.
*D06F 103/16* (2020.01)
*D06F 103/52* (2020.01)
*D06F 105/42* (2020.01)

(52) U.S. Cl.
CPC ..... *A47L 15/006* (2013.01); *A47L 15/0076* (2013.01); *A47L 15/4418* (2013.01); *A47L 15/449* (2013.01); *A47L 2401/00* (2013.01); *A47L 2401/02* (2013.01); *A47L 2501/07* (2013.01); *D06F 34/05* (2020.02); *D06F 34/14* (2020.02); *D06F 2103/00* (2020.02); *D06F 2103/16* (2020.02); *D06F 2103/52* (2020.02); *D06F 2105/42* (2020.02)

(58) Field of Classification Search
CPC ..... D06F 2103/00; D06F 2105/42; A47L 2401/00; A47L 2401/02; A47L 2501/07; A47L 15/449; A47L 15/0076; A47L 15/006; A47L 15/4418; A47L 15/0055
See application file for complete search history.

(56) References Cited

U.S. PATENT DOCUMENTS

| | | | |
|---|---|---|---|
| 10,780,470 | B2 | 9/2020 | Saier |
| 2013/0042652 | A1 | 2/2013 | Brueckner |
| 2013/0074942 | A1 | 3/2013 | Stingl |

FOREIGN PATENT DOCUMENTS

| | | | | |
|---|---|---|---|---|
| DE | 69017275 | T2 | 7/1995 | |
| DE | 102011119021 | B3 | 5/2013 | |
| DE | 102011122921 | A1 | 8/2013 | |
| DE | 102012012913 | A1 | 1/2014 | |
| DE | 102014002560 | A1 | 8/2015 | |
| DE | 102014010126 | A1 | 1/2016 | |
| DE | 102015107105 | A1 | 11/2016 | |
| DE | 102015107976 | A1 | 11/2016 | |
| DE | 102015110862 | A1 | 1/2017 | |
| DE | 102016101324 | A1 | 7/2017 | |
| DE | 102016102829 | A1 | 8/2017 | |
| DE | 102017103168 | B3 | 3/2018 | |
| DE | 102016125928 | A1 | 7/2018 | |
| DE | 102017114767 | A1 | 10/2018 | |
| DE | 102017114665 | A1 | 1/2019 | |
| DE | 102018113644 | A1 | 12/2019 | |
| DE | 102020106712 | A1 | 11/2020 | |
| DE | 102014204604 | B4 | 5/2021 | |
| EP | 2966299 | A1 | 1/2016 | |
| EP | 3091114 | A1 | 11/2016 | |
| EP | 3115498 | A1 | 1/2017 | |
| EP | 3192769 | A2 | 7/2017 | |
| EP | 3199930 | A1 | 8/2017 | |
| EP | 2783142 | B1 | 4/2018 | |
| WO | WO-2011138774 | A1 * | 11/2011 | ..... G01F 25/17 |

* cited by examiner

DOSING APPARATUS

The invention relates firstly to a metering device according to the preamble of claim 1.

Such metering devices are known in the prior art.

The applicants have been developing and selling metering devices of the kind in question for many decades through their affiliated companies Herbert Saier GmbH and Saier Dosiertechnik GmbH. With regard to the prior art, reference is made, for example, to publications DE 10 2016 102 829 A1, DE 10 2017 114 767 A1, DE 10 2017 103 168 A1, DE10 2016 125 928 A1, DE 10 2017 114 665 A1, DE 10 2018 113 644 A1, DE 10 2011 119 021 A1, DE 10 2011 122 921 A1, DE 10 2012 012 913 A1, DE 10 2014 002 560 A1, DE 10 2014 010 126 A1, EP 2 966 299 A1, DE 10 2015 110 862 A1, EP 3 115 498 A1, DE 10 2015 107 105 A1, EP 3 091 114 A1 and DE 10 2015 107 976 A1, all of which are attributable to the applicants.

The invention is specifically based on a metering device having the features of the preamble of claim 1, in particular on a metering device as is described, for example, in EP 2 783 142 A2.

Proceeding on this basis, the object of the invention is to develop the known metering device in such a way that the control device is now able to check whether a metering process has been carried out properly and/or in such a way that the control device is now able to obtain additional information about a metering process that has been carried out.

The invention achieves this object with the features of claim 1, in particular with those of the characterizing part, and is accordingly characterized in that the fluid line has at least one heating element and at least one temperature sensor connected to a measuring device, wherein by means of the measuring device, with the aid of a measurement value output by the temperature sensor, information about an effected conveyance of the medium through the fluid line which can be determined and can be transmitted to the control unit.

The principle of the invention consists in essence of assigning at least one heating element, at least one temperature sensor and at least one measuring device to the metering device. The heating element can apply thermal energy to the medium present in the fluid line, and the at least one temperature sensor—in particular arranged at a distance from the heating element—can measure the temperature present there.

In the event that the pump is not driven, the medium, for example a rinsing medium, is therefore in the fluid line and no conveyance of medium is effected, a specific temperature measurement value can be detected or measured at the temperature sensor depending on the actuation of the heating element.

The heating element can be actuated in particular continuously or in a clocked fashion or on demand or as necessary or according to a predetermined principle or scheme.

When the pump is activated and medium is conveyed through the fluid line, the measurable temperature applied to the temperature sensor changes. The measuring device can process and evaluate this change in the temperature measurement value and can determine, from this, information about the effected conveyance of the medium through the fluid line. This information can be transmitted from the measuring device to the control unit. As a result of the transmission of the information to the control unit, the control unit can carry out different processing steps.

For example, the information transmitted by the measuring device can be used by the control unit to work out a reference to the type of medium conveyed or a reference to the flow rate.

This information can be used by the control unit, for example to check whether the correct medium has been conveyed, or to determine what flow rate of medium has been conveyed, or to check whether the correct flow rate has been conveyed by the pump.

In one embodiment of the invention, it is provided that at least one heating element and at least two temperature sensors are provided. The temperature sensors are arranged in particular symmetrically with respect to the heating element, wherein a first temperature sensor is arranged downstream and a second temperature sensor is arranged upstream of the heating element. When the medium is stationary and not moving in the fluid line, the thermal energy introduced into the medium by the heating element is distributed evenly due to the symmetrical arrangement of the temperature sensors, assuming a symmetrical design of the fluid line and the components involved, so that the same or substantially the same temperature is measured at both temperature sensors. With this arrangement, there is a particularly simple possibility of a differential measurement, so that the temperature measurement values obtained, or in any case measurement values related to the temperature, for example voltages or currents, can be subtracted from each other.

Such a differential measurement is known in the prior art in other fields of application and offers particularly simple possibilities for evaluation.

As long as the medium is stationary, i.e. the pump is not activated, and no medium is conveyed through the fluid line, a differential measurement determines a value of zero or almost zero, since the two values emitted by the temperature sensors correspond to each other or substantially correspond to each other.

However, as soon as the medium moves through the fluid line, due to the response of the pump, and due to the medium conveyance through the fluid line, the temperature sensor located downstream of the heating element, due to the heat transport associated with the fluid flow, inevitably measures a different temperature than the temperature sensor located upstream of the heating element.

The differential measurement then provides meaningful, non-zero values.

Using an analogue measurement and evaluation method, information about a fluid transport can also be obtained if only a single temperature sensor is provided. Here, too, a changed measurement value can be detected as the result of a fluid flow, in relation to a situation in which the medium is in the fluid line.

A particular advantage of the metering device according to the invention is that the proposed measuring arrangement does not use any moving parts.

Metering devices have become known from the prior art in which impeller meters or oval wheel meters are used to measure fluid flows. However, moving parts are present here which, especially when using different media with different viscosities, provide imprecise measurement values and, in addition, are exposed to high mechanical stresses, so that failures are frequently recorded. The metering device according to the invention is completely maintenance-free due to an arrangement of heating element and temperature sensor.

The measurement principle according to the invention also offers the possibility of extremely short response times.

The invention recognizes that, in particular when operating a metering device which uses a peristaltic pump and in which even small metering quantities are conveyed, very exact and fast measurements and, as a result, very exact determinations of delivery quantities can be achieved. The metering device according to the invention also allows a very precise and reliable determination of a type of medium.

For this purpose, it can be provided in particular that the measuring device or a computer unit cooperating therewith or a computer unit connected downstream thereof, or alternatively also the control unit, processes the measurement values obtained, and from the signal form, for example from the signal length, or from the signal amplitude, or from the behavior of signal rising edges, or of signal falling edges, or by frequency analyses or spectral analyses, or by testing or determining periodicities, or by testing signal patterns, delay times, phase delays etc., very precise determinations of delivery quantities for different media and different viscosities can be achieved as well as very precise determinations of different types of media.

For this purpose, a memory can advantageously be assigned to the control unit, with values for different media or values for different delivery quantities or for different delivery capacities of the pump being stored in said memory. The values can include, for example, values of different signal patterns, signal shapes, signal types, signal rising edges or signal falling edges, periodicities, delay times, phase delays, signal amplitudes and other signal properties.

The control unit can, with recourse to the memory, carry out an assessment, for example make a comparison between the measurement value and the value stored in the memory and, for example on the basis of this assessment, for example on the basis of this comparison, carry out a determination or a check, for example as to what type of medium has been conveyed and/or what flow rate of a certain medium or type of medium or class of medium has been conveyed.

The metering device according to the invention is used for metering and supplying media via a fluid line to at least one target apparatus.

The target apparatus can be provided, for example, by a commercial textile washing machine or a commercial dishwasher. However, other target apparatus can also be considered, to which the same or different, possibly successive, media must be supplied regularly or irregularly.

The metering device is connected on the input side to at least one container that is filled with a medium. The container can, for example, comprise an access opening for a suction lance, which has a hose line that can be connected to the metering device.

With regard to suction lances that can be used in conjunction with the invention, reference is made, for example, to German patent application DE 10 2020 106 712 A1 in the name of the applicants, the content of which is hereby included in the disclosure content of the present patent application for the purpose of avoiding repetition.

However, the metering device can also be connected on the input side to a plurality of containers that are filled with the same medium or with different media. In particular, the metering device according to the invention serves to successively feed different media to a target apparatus. In this regard, reference is made, for example, to EP 2 783 142 A2 in the name of the applicants, the content of which is hereby included in the content of the present patent application.

The metering device can be equipped with a so-called mixture distribution device, which is described and disclosed in the aforementioned patent application. Such a mixture distribution device can have an actuator which can be activated by the control unit and which switches different communication paths so that in each case a specific one of the plurality of containers can be connected to the target apparatus and in this way successive different media can be fed to the target apparatus.

At least one of the media can be configured as a rinsing medium, so that each time after conveying a medium, a rinsing medium can be conveyed to rinse the line paths.

A medium within the meaning of the present patent application is a liquid, for example highly concentrated, agent which can be used, for example, in the washing or cleaning of objects or textiles, for example a component of a detergent, or a chemical which is required, for example, as part of a washing or cleaning process. The medium can be any material as described, for example, in EP 2 783 142 A2 or as described in any of the other referenced publications.

The metering device has a control unit. This can be a device having a computer unit, for example a microprocessor. The control unit can have one or more electronic components. It can be organized centrally or decentrally.

The control unit can, for example, cause a pump to be activated, for example when prompted by a target apparatus, for example after a program selector switch on a target apparatus has been actuated and a washing or cleaning program has been selected. The pump can in particular be a peristaltic pump.

By activating the pump, a predetermined amount of medium can be removed from the container and conveyed to the target apparatus.

The invention also comprises metering devices that are connected on the output side to a plurality of target apparatus. In particular, a second mixture distribution device can be provided, which comprises an actuator that switches the communication paths accordingly.

In particular, during a washing process in a washing machine, it can be provided that the washing machine requests different media in different quantities from the metering device at different times during the washing program.

The metering device, in the event that different containers are connected on the input side, can address the actuator so that the correct communication path to the correct container is established, and can then cause the pump to deliver a predetermined amount of medium to the target apparatus for a predetermined period of time or a predetermined number of revolutions.

With the heating element and the temperature sensor provided in accordance with the invention, the control unit can obtain information from the measuring device about the effected conveyance of the medium through the fluid line. The control unit can use this information, for example, to check whether the correct medium or the correct type or class of medium has been conveyed.

The control unit can also or alternatively use the information to check whether the correct flow rate has been conveyed.

The invention also allows a verification that a certain volume of medium has been conveyed to a target apparatus. Such a process, also referred to as POD (proof of delivery), can provide that a corresponding heating element and at least one temperature sensor are arranged on the input side or at least upstream of a target apparatus, in particular of each target apparatus, and a measuring device that transmits corresponding information to the control unit.

Alternatively and/or additionally, this information can also be transmitted to a control apparatus of the target apparatus.

For the understanding of the invention and the interpretation of the terms used, reference is made to the other publications in the name of the applicants, the contents of which are hereby included in the disclosure content of the present patent application. The technical teaching according to the present patent application can be combined with all the technical teachings of the publications referred to below. These are the following publications in the name of the applicants:

DE 10 2016 102 829 A1, DE 10 2017 114 767 A1, DE 10 2017 103 168 A1, DE 10 2016 125 928 A1, DE 10 2017 114 665 A1, DE 10 2018 113 644 A1, DE 10 2011 119 021 A1, DE 10 2011 122 921 A1, DE 10 2012 012 913 A1, DE 10 2014 002 560 A1, DE 10 2014 010 126 A1, EP 2 966 299 A1, DE 10 2015 110 862 A1, EP 3 115 498 A1, DE 10 2015 107 105 A1, EP 3 091 114 A1 and DE 10 2015 107 976 A1

According to the invention, the measuring device uses a measurement value output by the temperature sensor to determine information about an effected conveyance of the medium through the fluid line. The measurement value output by the temperature sensor can, for example, directly comprise a measured temperature or a measured variable that is related to a temperature, for example a measured voltage, a measured current or a measured resistance. It is crucial that the measurement value correlates in some way with the temperature value applied to the temperature sensor.

The formulation according to which the measurement value is output by a temperature sensor comprises the fact that the measurement value is directly or indirectly queried by a temperature sensor or is otherwise directly or indirectly obtained by the measuring device from the temperature sensor.

According to the invention, at least one heating element and at least one temperature sensor are provided. This formulation includes embodiments in which the temperature sensor is integral with the heating element, or the heating element also at the same time constitutes or comprises the temperature sensor.

For example, a heating element can be provided which cooperates with a controller for the heating element which ensures a constant temperature or a target temperature of the heating element, wherein it can be determined from the type of actuation of the heating element, for example in order to keep the temperature constant, whether medium is moving within the fluid line and what fluid quantities are currently being conveyed. For example, a heating controller for the heating element can be formed in such a way that it controls the latter in the sense of a constant temperature, such that the heating element always has a constant temperature of 35° C., for example. As long as the medium is in the fluid line and is not being conveyed, this temperature, which is greater than room temperature, can be maintained by supplying only very little heat energy.

If the pump is activated and the medium is conveyed through the fluid line, considerably more heating energy must be expended to keep the heating element at this target temperature. The type and degree of actuation of the heating element can therefore indirectly likewise be a measure of the fluid conveyance and the quantity of the conveyed fluid, so that the measurement of the type of actuation of the heating element also indirectly provides a configuration of a temperature sensor within the meaning of the invention.

According to the invention, the heating element together with the temperature sensor can also be provided by an integrated component, for example. This can, for example, comprise a temperature-dependent resistor.

In particular, such a device can be provided by an NTC (Negative Temperature Coefficient) component or by a PTC (Positive Temperature Coefficient) component.

Further advantageously, such an electronic component can cooperate with a constant current source. The voltage dropping across the component can be measured and represents a measure of the temperature-dependent resistance. This measurement value is thus also a measure of its current temperature. The current temperature of the electronic component depends on whether the medium surrounding the component is stationary or flowing and also depends, for example, on the heat capacity of the particular medium.

From a value of the voltage dropping across the electronic component when supplied via a constant current source, information about a conveyance of medium can therefore be determined.

Any suitable type of pump, for example a peristaltic pump, diaphragm pump or centrifugal pump, is regarded as a pump of a metering device within the meaning of the invention. A pump within the meaning of the invention is in particular a device with which a fluid, in particular a liquid, can be conveyed.

The invention also comprises metering devices with pumps that work with suction principles, for example according to the Venturi principle. Here, for example, by opening a valve on a water line and, for example, by opening a further valve of a media line which communicates with the water line, a negative pressure is created in the media line for the purpose of entraining media. Such a pump is also called a vacuum pump, suction pump, Venturi pump or Venturi nozzle, jet pump or water jet pump.

According to an advantageous embodiment of the invention, it is provided that the measurement value is based on a measured temperature or takes into account a measured temperature.

This embodiment allows particularly simple signal processing and a fast response time.

According to an advantageous embodiment of the invention, it is provided that the fluid line comprises a pair of temperature sensors.

This embodiment allows particularly good signal processing and simple and precise measurement to determine that media conveyance has occurred or to determine what amount of media and what type of media has been conveyed.

According to an advantageous embodiment of the invention, it is provided that the two temperature sensors are arranged symmetrically or substantially symmetrically relative to the heating element.

This allows a particularly simple embodiment of a measuring device and a particularly elegant and precise signal processing of the obtained measurement values.

According to an advantageous embodiment of the invention, it is provided that a first temperature sensor is arranged upstream of the heating element and a second temperature sensor is arranged downstream of the heating element.

This allows particularly precise signal-related processing.

According to an advantageous embodiment of the invention, it is provided that the measuring device can be used to compare the values output by the two temperature sensors, in particular in the manner of a differential measurement, wherein information about an effected conveyance of the medium through the fluid line can be determined from the comparison by means of the measuring device and can be transmitted to the control unit.

This embodiment allows a particularly simple signal processing and signal evaluation. For example, conventional methods for processing differential measurement values, which have become known in other areas of technology, can be used.

According to an advantageous embodiment of the invention, it is provided that the heating element and the temperature sensor or the pair of temperature sensors are combined to form one assembly unit.

This allows recourse to commercially available component parts. In addition, particularly simple handling is made possible.

According to an advantageous embodiment of the invention, it is provided that the assembly unit comprises an analogue output or a digital interface for a signal output.

The embodiment can provide that analogue signal outputs are provided at the assembly unit, so that the control unit or electronics connected upstream of the control unit—or the measuring device—processes these analogue measurement values. Alternatively, the assembly unit can have a digital interface, for example an $I^2C$ interface.

The last variant requires, for example, that a computer unit is already arranged in the assembly unit and carries out a signal processing or signal pre-processing of the obtained measurement values. It can be provided here, for example, that a differential measurement or a comparative measurement is already effected in the assembly unit. In particular, the measuring device can also be arranged on the assembly unit.

Alternatively, the assembly unit can also be connected to a measuring device.

It can also be provided that signal processing is effected in the assembly unit.

According to an advantageous embodiment of the invention, it is provided that the assembly unit comprises a computer unit.

This embodiment allows a particularly advantageous system architecture, so that the control unit can be relieved of computing steps and a pre-calculation takes place in the assembly unit.

It is irrelevant for the invention whether exclusively all computing and processing steps are carried out by the control unit, or all computing steps are carried out by a computer unit of the assembly unit, or whether these two electronic components, possibly with additional electronic components, share the computing work, and/or the signal processing work.

According to an advantageous embodiment of the invention, it is provided that the computer unit is connected to the control unit.

This embodiment allows very efficient signal processing to be effected.

According to an advantageous embodiment of the invention, it is provided that the heating element is arranged between the pump and the target apparatus, in particular directly downstream of the pump.

This embodiment allows for a particularly compact design. In particular, the component can be arranged directly downstream of the pump. This makes it possible to provide the heating element or the component as part of the metering device and to form it integrally with the metering device. This positioning of the heating element or this positioning of the component close to the pump can also ensure that the pipe routes are kept short. Therefore, there is no need to worry about a considerable dilution of medium with rinsing medium, such as water, in the measurement and detection range of the temperature sensor.

According to an advantageous embodiment of the invention, it is provided that the heating element is arranged upstream, in particular directly upstream, of the pump, in particular downstream of an input of the metering device.

This embodiment allows a particularly compact arrangement and integration of the heating element, in particular an integration of the component, into the metering device.

According to an advantageous embodiment of the invention, it is provided that at least one heating element is assigned to a target apparatus and/or that at least one heating element is assigned to the metering device.

This embodiment makes it easy to provide and ensure a proof-of-delivery=POD principle.

According to an advantageous embodiment of the invention, it is provided that a first assembly unit, in particular for measuring a flow rate, is assigned to the metering device, and that at least one second component unit is assigned to a target apparatus.

This embodiment allows a simple system architecture to achieve particularly reliable metering processes.

According to an advantageous embodiment of the invention, it is provided that the first assembly unit and the second assembly unit are connected to the control unit.

This embodiment of the invention provides a metering device with which metering processes are configured to be particularly reliable.

According to an advantageous embodiment of the invention, it is provided that a plurality of target apparatus are connected to the metering device, and each target apparatus is assigned an assembly unit.

This embodiment helps to increase reliability in metering processes.

According to an advantageous embodiment of the invention, it is provided that at least one assembly unit is configured to provide a POD (=proof of delivery) signal.

This makes the metering process particularly reliable. According to the invention, the POD signal can be processed by the control unit and/or by a control apparatus of a target apparatus. In particular, the POD signal can be further processed for documentation purposes.

According to an advantageous embodiment of the invention, it is provided that the heating element and the temperature sensor are an integral part of the metering device and/or are permanently connected to the metering device.

This embodiment allows a particularly compact design of the metering device.

According to an advantageous embodiment of the invention, it is provided that the information has a reference to a flow rate.

This embodiment allows the flow rate to be determined, in particular taking into account further data available to the control unit. For example, the control unit can use the response times of the pump, for example the number of revolutions of the pump for conveying the medium, which is known per se, or the duty cycle of the pump, which is known per se, to check by comparative observation whether the pump is functioning properly and has conveyed the intended flow rate, or whether the pump needs to newly calibrated or recalibrated.

In particular, the control unit can relate the information obtained to a type of medium already known per se to the control unit. For example, a metering device that allows a connection of a plurality of containers on the input side can have previously manually or automatically obtained information about what medium is in what container or what medium has just been conveyed. If the metering device receives information from the measuring device that has a reference to a flow rate, the control unit can, for example, precisely determine or check the flow rate of this medium, taking into account the information about the type of medium that is already available.

According to an advantageous embodiment of the invention, it is provided that the information has a reference to a type of conveyed medium.

In this way, the metering device can check or verify whether the correct medium has been conveyed.

According to an advantageous embodiment of the invention, it is provided that the control unit receives media information, referred to as second information, about the type of medium conveyed or to be conveyed, independently of the measuring device.

The control unit can, for example, receive media information about the medium conveyed or to be conveyed from an operator who, for example, when connecting different containers or when filling different containers at the metering device, enters information at an interface about what medium has been connected to what input of the metering device. Such an information input can of course also be automated, for example with the aid of the suction lances.

The control unit thus has, in different ways, information about the conveyed medium or the medium to be conveyed that has reached it: The control unit has received first information about the medium from the measuring device. The control unit has received second information from a user or automatically when connecting the containers or suction lances. These two pieces of information can be compared and processed by the control unit.

If the control unit determines during such a comparison that a check shows that the metering process has been carried out properly, this can be documented.

If, however, the control unit determines during a comparison that the two pieces of information contradict each other because, according to the first information, a first type of medium should have been conveyed, but according to the second information available to the control unit, a different medium should actually have been conveyed due to a specific connection of a container with a specific medium to the control unit, the control unit can issue or initiate an error or warning message or take this into account in a documentation step.

According to an advantageous embodiment of the invention, it is provided that the information can be related to the second information by means of the control unit.

With this embodiment, a check can be carried out to see whether the correct medium has been conveyed.

According to an advantageous embodiment of the invention, it is provided that the information from the control unit can be used to carry out a determination or a check of the following:

a) whether medium was conveyed, and/or
b) what volume of medium was conveyed, and/or
c) what medium was conveyed, and/or
d) whether the correct medium was conveyed,
or
to document metering processes carried out with the metering device.

This embodiment allows a multitude of processing of the metering device, which serves in particular to design the metering process in a particularly reliable manner.

Documentation of metering processes can, for example, be performed or initiated by the control unit of the metering device, wherein the data of the documentation is stored or temporarily stored as appropriate and, if required, transferred to a system controller or to an external device via an external interface, for example via the Internet, WLAN or the like. Documentation of metering processes can also be carried out in such a way that the control unit transfers information to a control apparatus of a target apparatus that a metering process has been successfully completed and the further documentation is then initiated by the control apparatus of the target apparatus.

According to an advantageous embodiment of the invention, it is provided that the information can be used by the control unit to carry out a determination or a check of the operability of the pump or to calibrate the pump.

In this way, it can be checked, for example regularly or irregularly, whether the pump is working properly or whether ageing processes of the metering device, for example age-related behavior of the hoses providing the fluid line, require an adjustment.

According to an advantageous embodiment of the invention, it is provided that, when carrying out the determination or when carrying out the check or when carrying out the documentation, the control unit can use information about a type or a flow rate of the medium and/or information about a density of the medium and/or information about a viscosity of the medium and/or about a temperature of the medium.

This embodiment allows particularly reliable process management.

According to an advantageous embodiment of the invention, it is provided that the pump is provided by a peristaltic pump.

This makes it possible to fall back on conventional pumps known per se.

According to an advantageous embodiment of the invention, it is provided that a signal detected by the measuring device is subject to a pulsation which can be detected by the measurement electronics and can be data-processed and/or evaluated.

This embodiment recognizes that pulsations occur in the flow behavior of the conveyed fluid, particularly in peristaltic pumps, wherein the pulsations can be made visible in the measurement signal by means of the metering device according to the invention due to the short response times. Furthermore, this embodiment recognizes that the pulsations contained in the signal allow a statement to be made about the delivery quantities and/or also a statement to be made about the type of fluid being delivered.

According to an advantageous embodiment of the invention, it is provided that the control unit can be used to infer the type of conveyed medium by taking into account differences in the pulsations of the signal when using different media.

This allows a particularly reliable and elegant determination of a media type or checking thereof.

According to an advantageous embodiment of the invention, it is provided that the control unit is assigned a memory in which values, for example calibration values, comparison values or signal patterns, are stored for different media and/or for different delivery quantities or delivery capacities and/or for rinsing media, such as water.

This allows particularly reliable signal processing and a high quality and precision of the checking and determination of delivery quantities.

The control unit can also access the values stored in the memory for the calculations to be carried out. Alternatively and/or additionally, it can also be provided that the measuring device can fall back on the values stored in the memory.

According to an advantageous embodiment of the invention, it is provided that the control unit or a computer unit assigned thereto evaluates the information with recourse to the memory and with the aid of signal processing methods, such as spectral analysis.

This allows a particularly precise determination of conveyed volumes and the exact determination of a media type.

According to an advantageous embodiment of the invention, it is provided that at least one medium is provided by a rinsing medium, in particular water.

This embodiment of the metering device according to the invention takes into account that advantageously a rinsing with a rinsing medium takes place each time after metering of a medium. The measuring device can also determine information for the rinsing medium in accordance with the invention. For example, volumes of rinsing medium can be determined and checked. This information can be used to check and verify the operability of the pump.

According to an advantageous embodiment of the invention, it is provided that the heating element and/or the temperature sensor has a coating. This coating comprises, for example, parylene or polyurethane. Alternatively, coatings formed of or comprising ceramic materials are also possible, as are coatings with resins, in particular epoxy resins.

This coating allows trouble-free operation of the metering device and a long service life, especially when using different media.

According to an advantageous embodiment of the invention, it is provided that a plurality of containers with the same or different media are connected to the input side of the metering device, wherein the metering device has a mixture distribution device with an actuating element which can be activated by the control unit and which switches different communication paths in different actuating positions in order to successively supply different media to the target apparatus.

This exemplary embodiment allows different media to be fed successively to one or more target apparatus.

According to this exemplary embodiment of the invention, the media in the containers have in particular different viscosities and/or different thermal conductivities.

In one exemplary embodiment of the invention, it can be provided that the measuring device, in particular in cooperation with the control unit, is configured to take into account information about different media or information about different viscosities of the conveyed media during the signal processing.

The invention thus provides a very broad field of application, allowing reliable determination of the type of medium and reliable determination of the delivery quantities, or in each case checking thereof, over a wide range of different media.

According to a further aspect, the invention relates to a method for metering and supplying media via a fluid line to at least one target apparatus.

The invention is based on the object of developing a method known from the prior art in such a way that the metering process is configured reliably.

In order to avoid repetition, reference is made to the above explanations with respect to the understanding of the features and the advantages of the inventive method for metering and supplying media.

According to an advantageous embodiment of the invention, the method is characterized by the step of:

transmitting the information to the control unit.

This embodiment allows particularly simple signal processing of the information.

According to an advantageous embodiment of the invention, it is provided that the method is characterized by the step of f) using the information from the control unit to carry out a determination or a check of the following:

i) whether medium was conveyed, and/or ii) what volume of medium was conveyed, and/or iii) what medium was conveyed, and/or iv) whether the correct medium was conveyed, and/or to document metering processes carried out with the metering device, and/or to carry out a determination or a check of the operability of the pump or to calibrate the pump.

This embodiment allows particularly reliable process management.

According to a further aspect, the invention relates to a metering device.

The present invention is based on the object of developing a metering device of the kind described at the outset in such a way that it permits improved execution of metering processes.

The invention achieves this object with a metering device that has a temperature measuring device with which a temperature of at least one medium or a temperature of an environment of the metering device can be measured, wherein temperature information about the measured temperature can be transmitted to the control unit of the metering device, and wherein the control unit is configured to take the temperature information obtained into account when actuatiing the pump for carrying out a metering process or when calibrating the pump.

The principle according to the invention is that the metering device has a temperature measuring device. According to the invention, the temperature of a medium or a temperature of an environment of the metering device, i.e. an environment in which the metering device is located or in which the medium is located, can be measured with the temperature measuring device.

The information regarding the temperature to be measured is referred to as temperature information. This temperature information can be transmitted to the control unit of the metering device. For this purpose, the control unit of the metering device can, for example, be connected directly or indirectly to the temperature measuring device.

The control unit can subsequently take the obtained temperature information into account when actuating the pump.

This consideration can be made in the course of carrying out a metering process or also when calibrating the pump. The invention recognizes that the viscosity of media, including also the viscosity of water, is temperature-dependent. In conjunction with the carrying out of metering processes, for example in the field of commercial rinsing or commercial washing, media for which the viscosity increases with increasing temperature are regularly used. However, media are also known, for example, for which the viscosity decreases with increasing temperature. The differences in viscosity can be decisive in certain temperature ranges and significant for metering processes and, if not taken into account, may lead to improper metering processes.

Different viscosities lead to different flow behavior of the media. For example, conveying a medium with a peristaltic pump is unproblematic if the medium has a low viscosity, but can cause problems if it has a higher viscosity. In order to be able to meter the exact amount of medium required for the washing or cleaning process even at different temperatures of the medium or at different ambient temperatures, the control unit can take into account the temperature-dependent differences in viscosity and, for example, can allow the pump to deliver the medium over a longer running time at higher temperatures, thus compensating for the higher viscosity and, as a result, delivering the required and desired amount of medium to a target vessel.

According to an advantageous embodiment of the invention, viscosity information is stored in a memory of the metering device. This includes information about different viscosities of different media at different temperatures. For example, continuous or discrete values for the viscosity can be stored here. This viscosity information can be stored in the form of algorithms, curves, tables etc.

According to another advantageous embodiment of the invention, the control unit can relate the temperature information to the viscosity information. After relating this information, the control unit can take the viscosity information and the temperature information into account when carrying out a metering process or an operation to calibrate the pump.

In an advantageous embodiment of the invention, the temperature measuring device is provided by the temperature sensor. Here, the invention kills two birds with one stone: The temperature sensor, with the help of which information about the performed conveyance of the medium through the conveying line can be determined, can at the same time be used to obtain information about the temperature of the medium or the environment in order to be able to take temperature-dependent viscosities of the medium into account in a metering process.

Figure 2A:
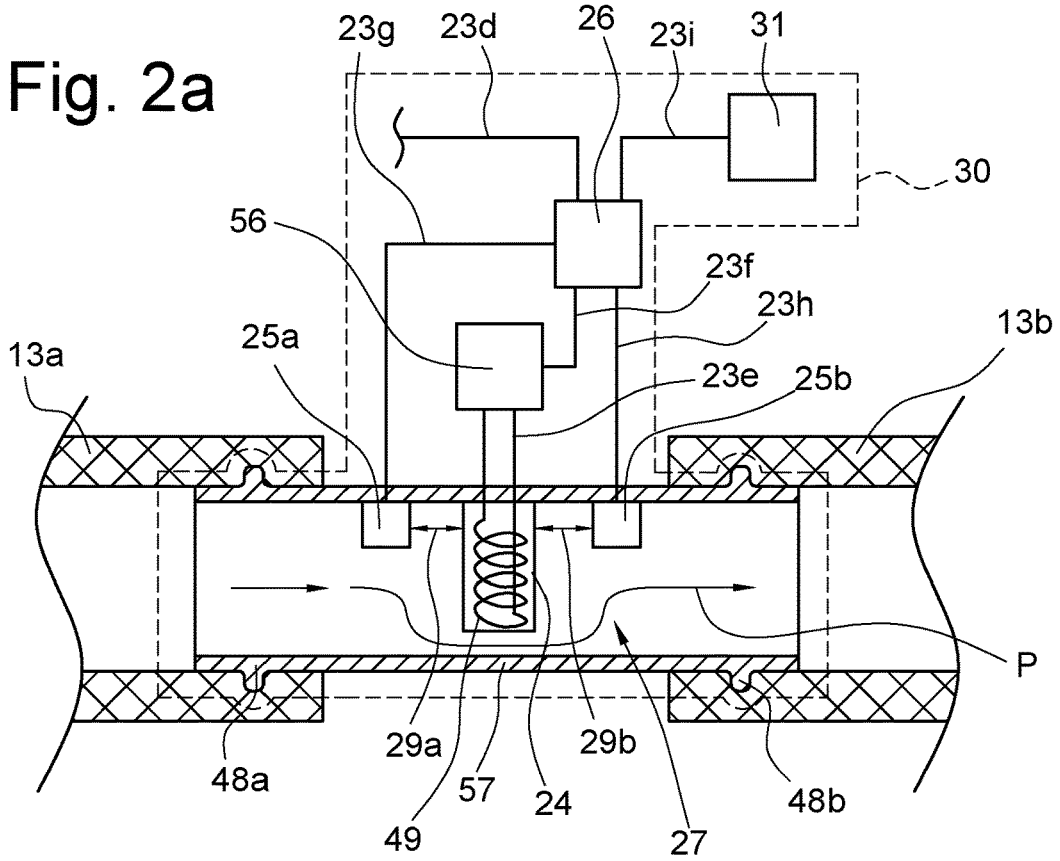
Figure 2B:
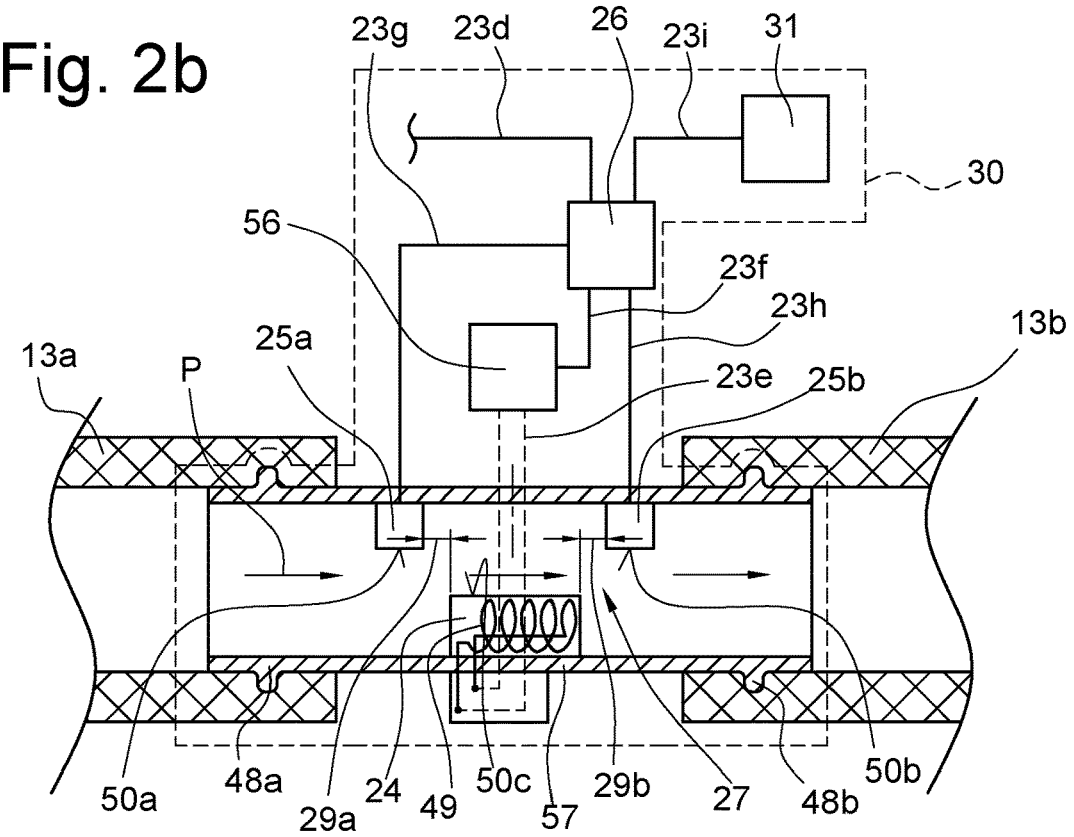
Figure 2C:
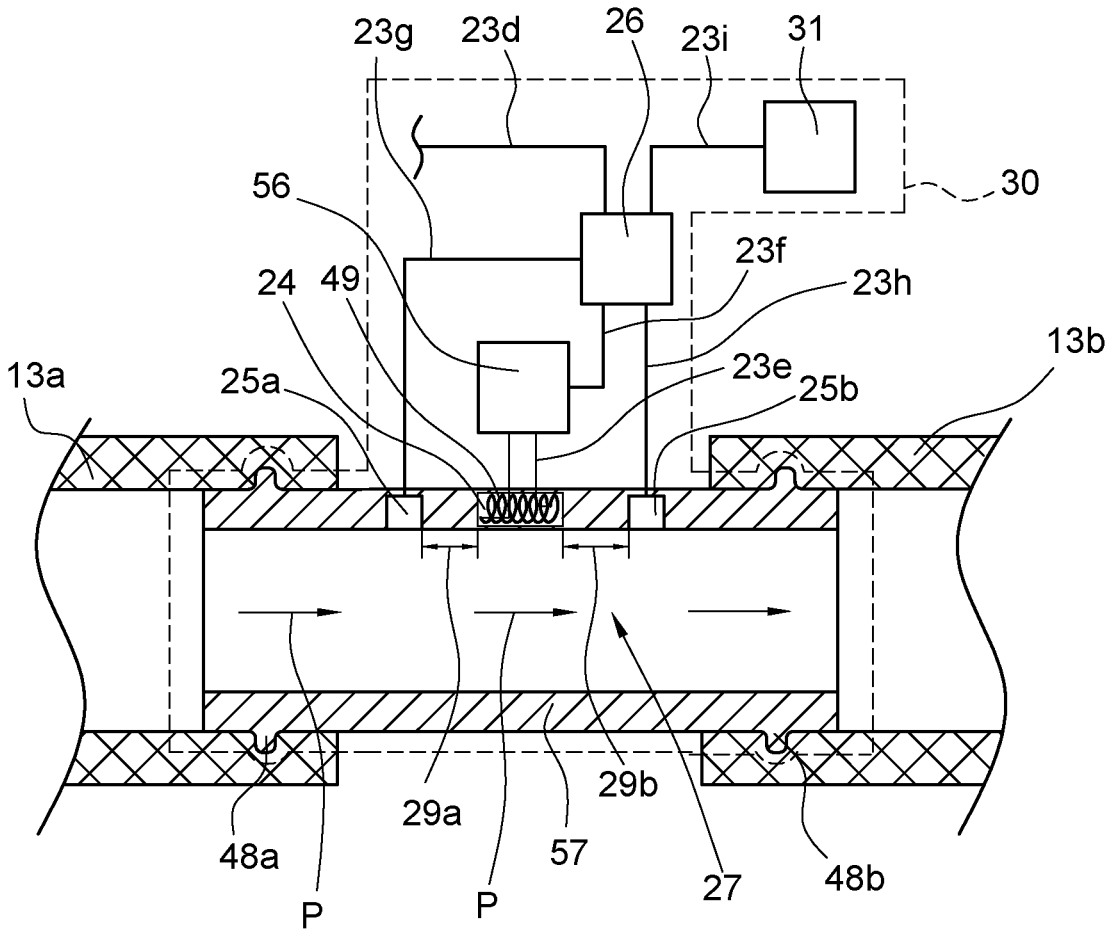
Figure 3:
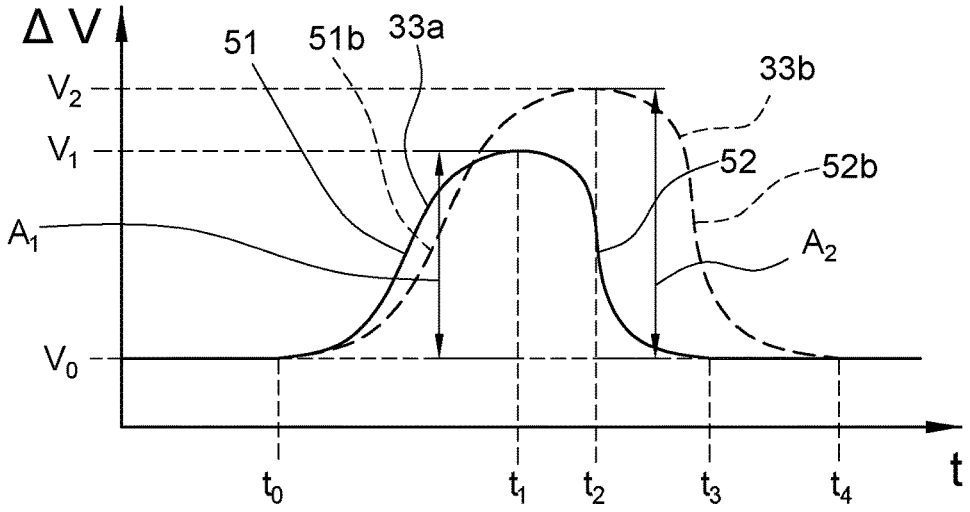
Figure 4:
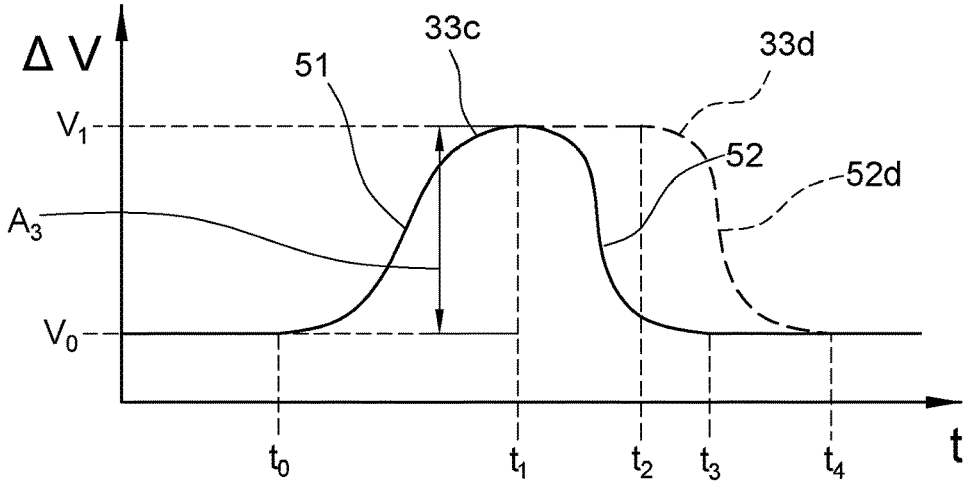
Figure 5:
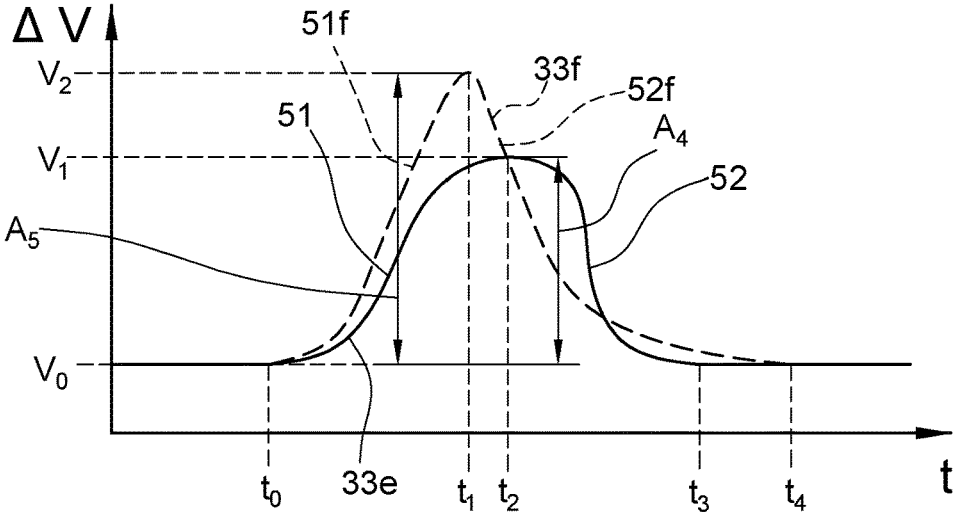
Figure 6:
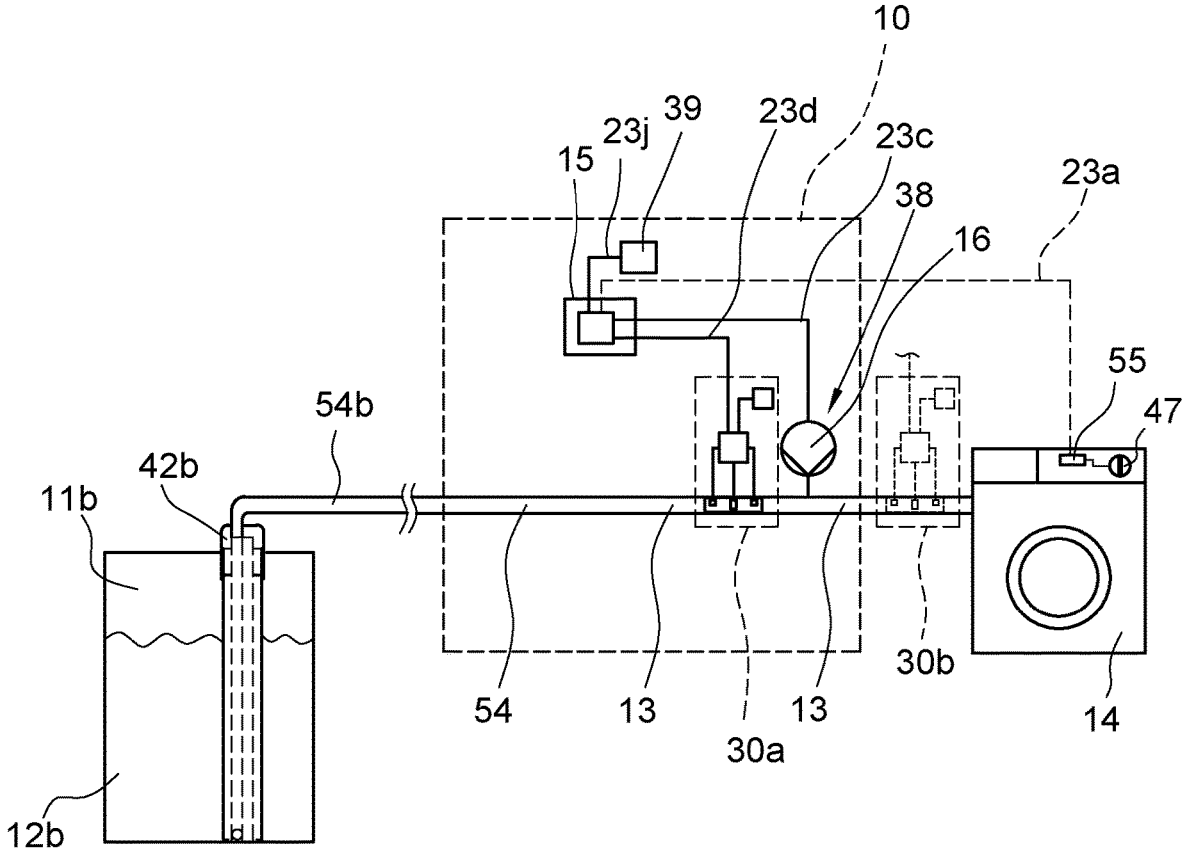
Figure 7A:
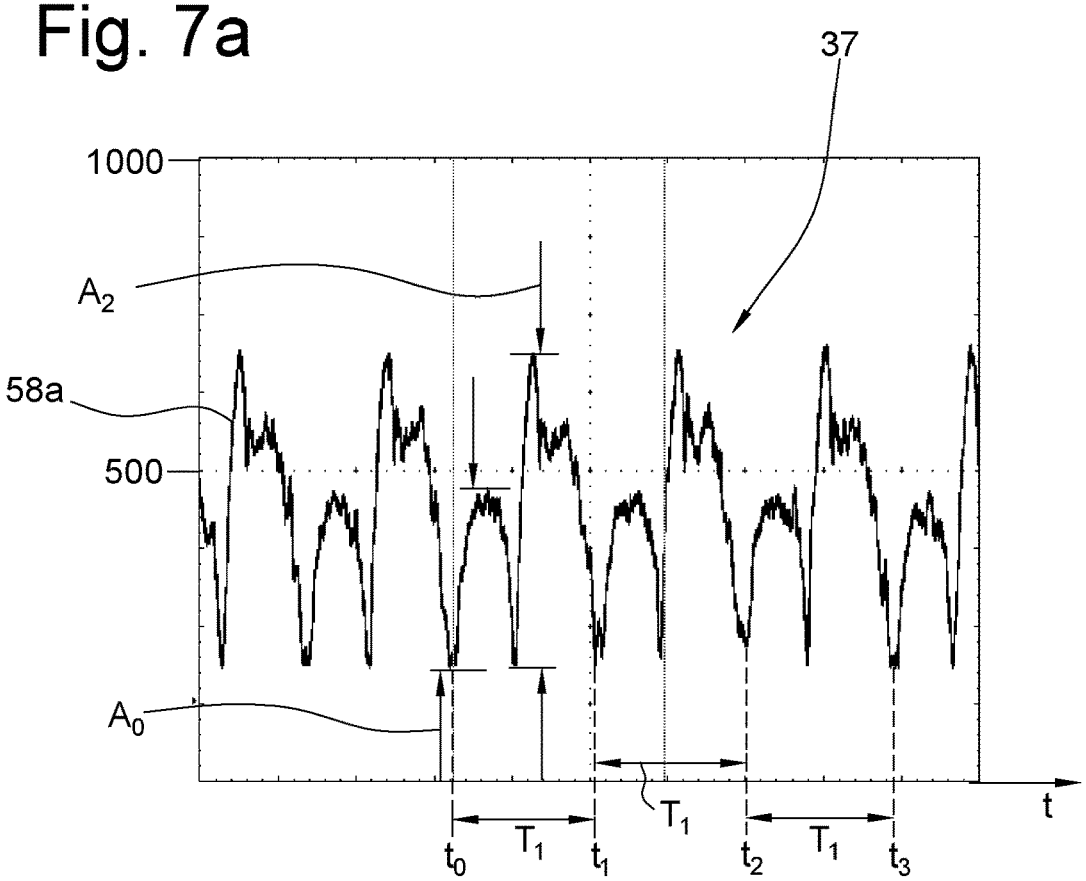
Figure 7B:
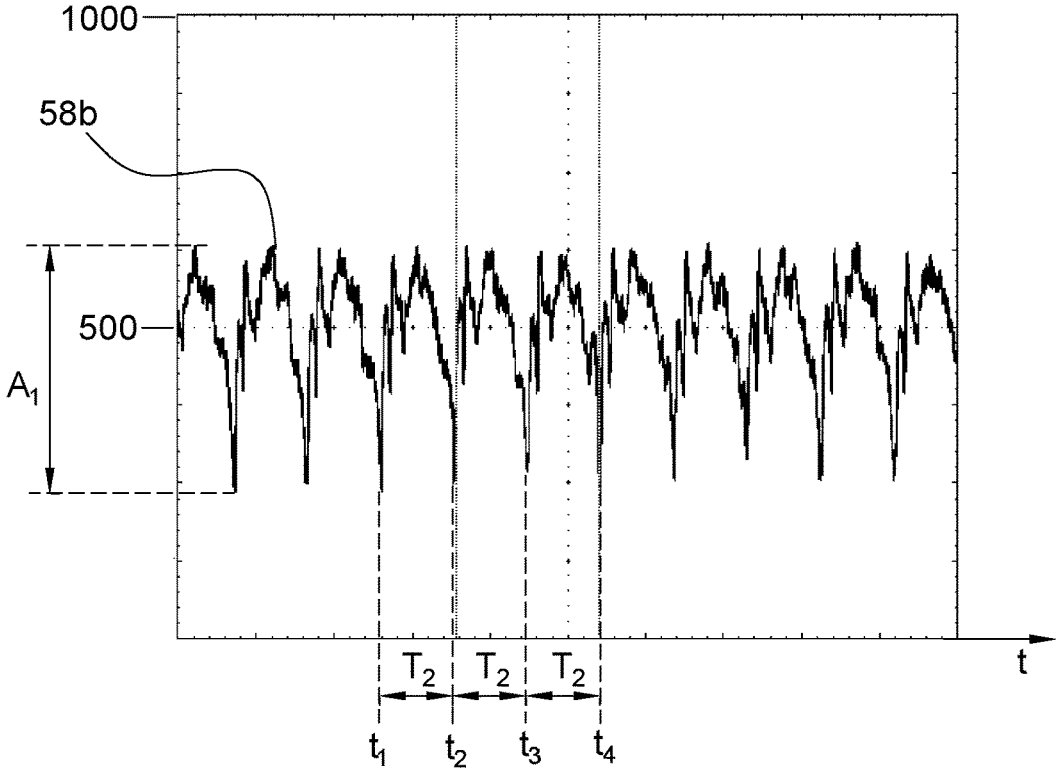
Figure 7C:
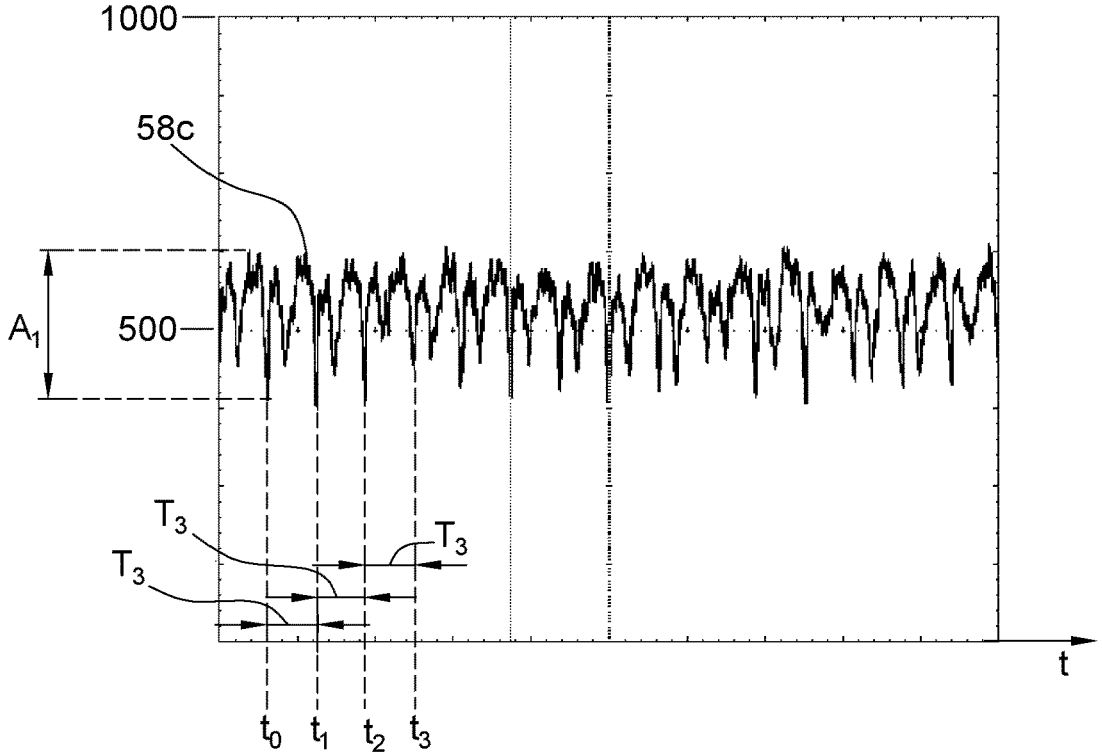
Figure 7D:
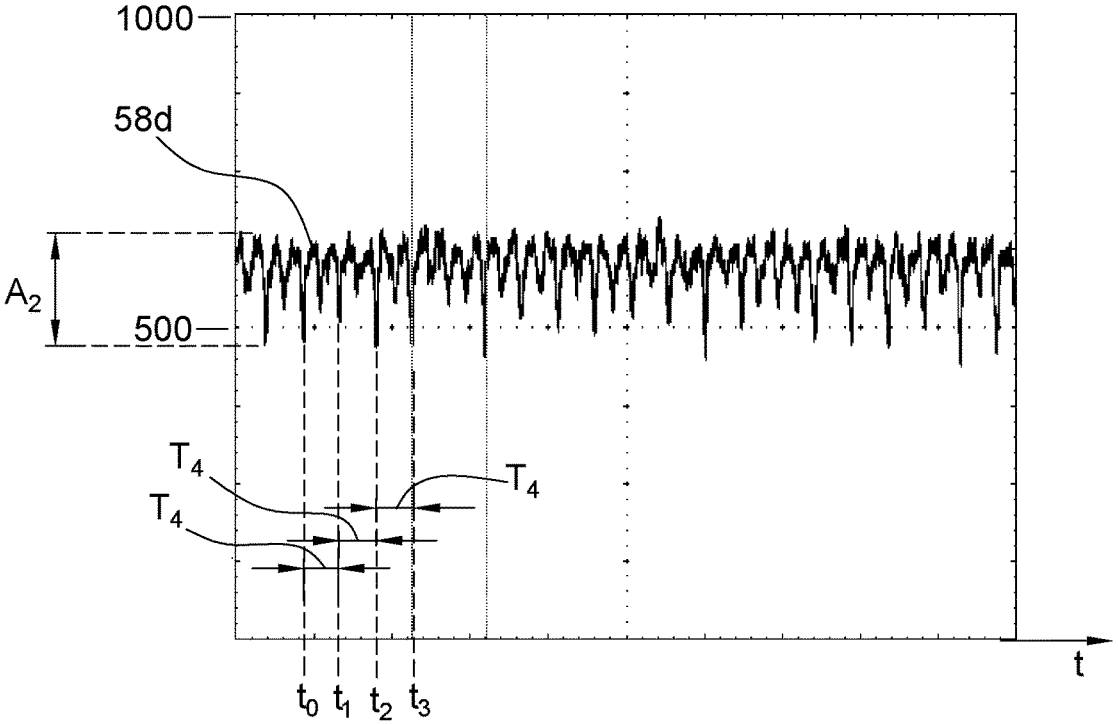
Figure 8A:
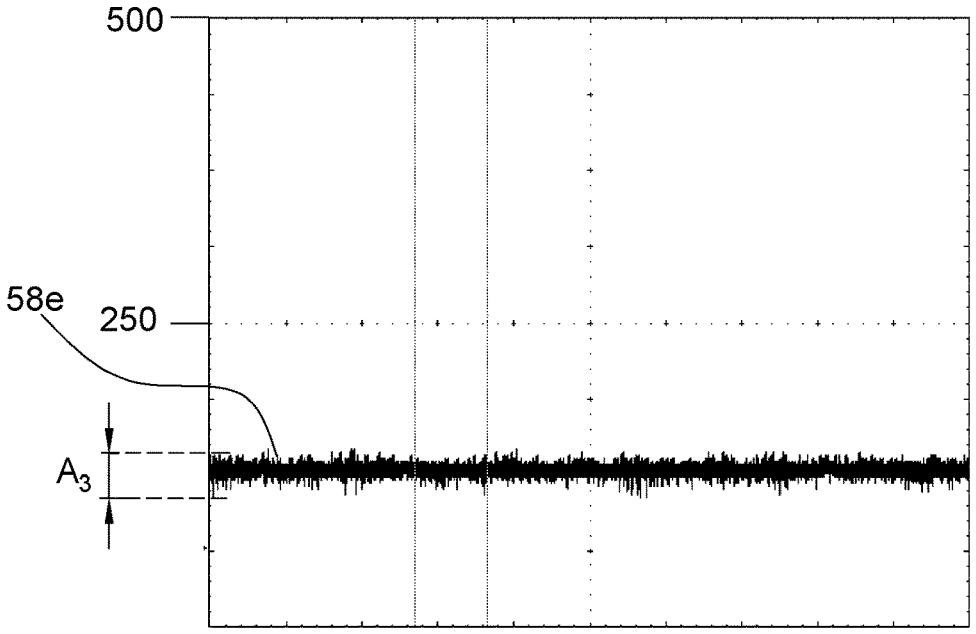
Figure 8B:
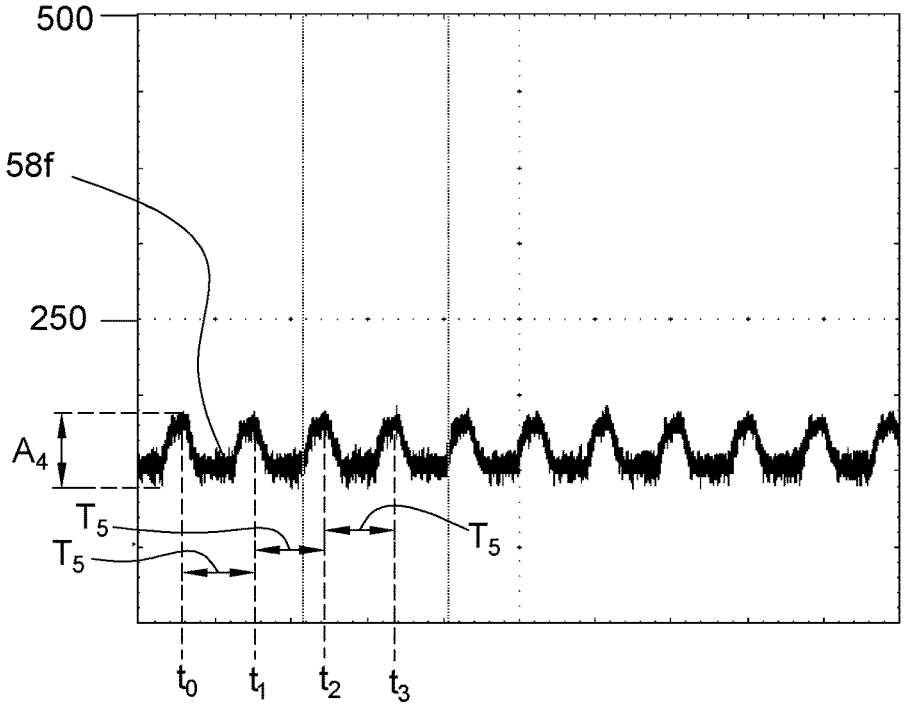
Figure 8C:
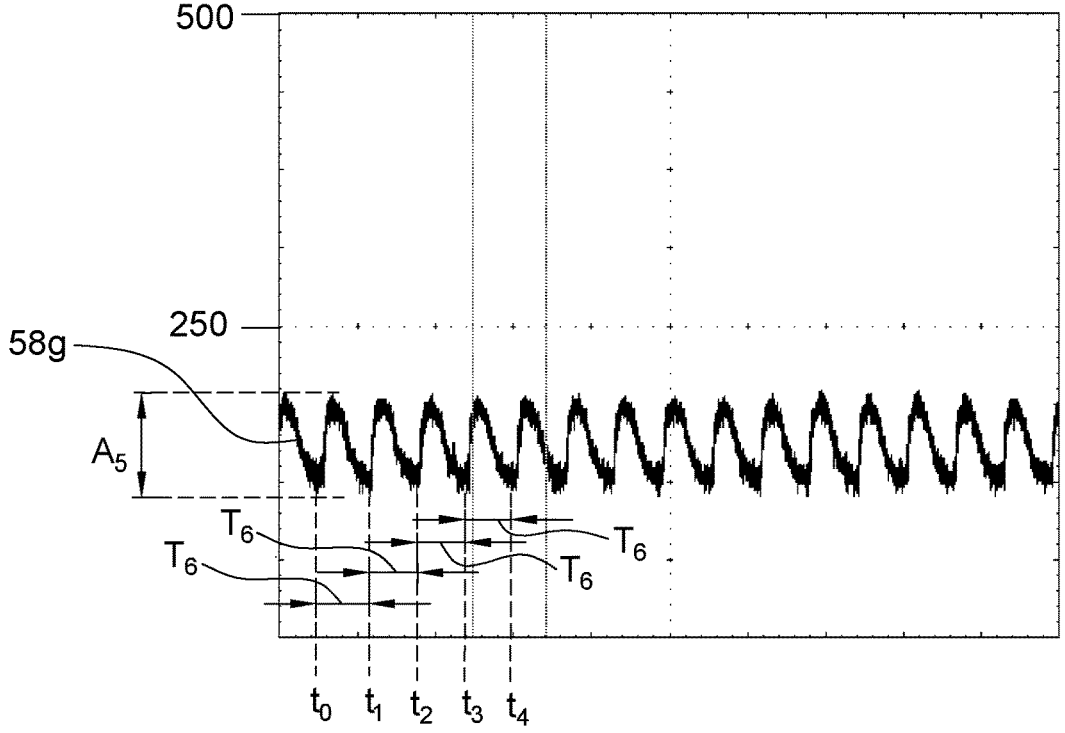
Figure 8D:
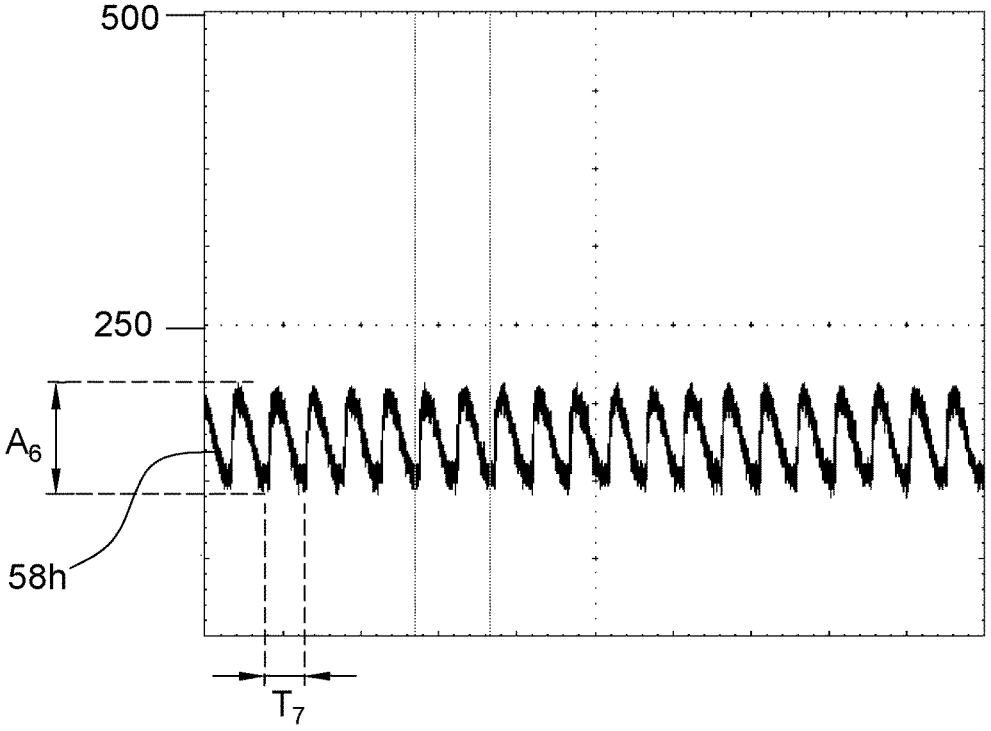
Figure 9:
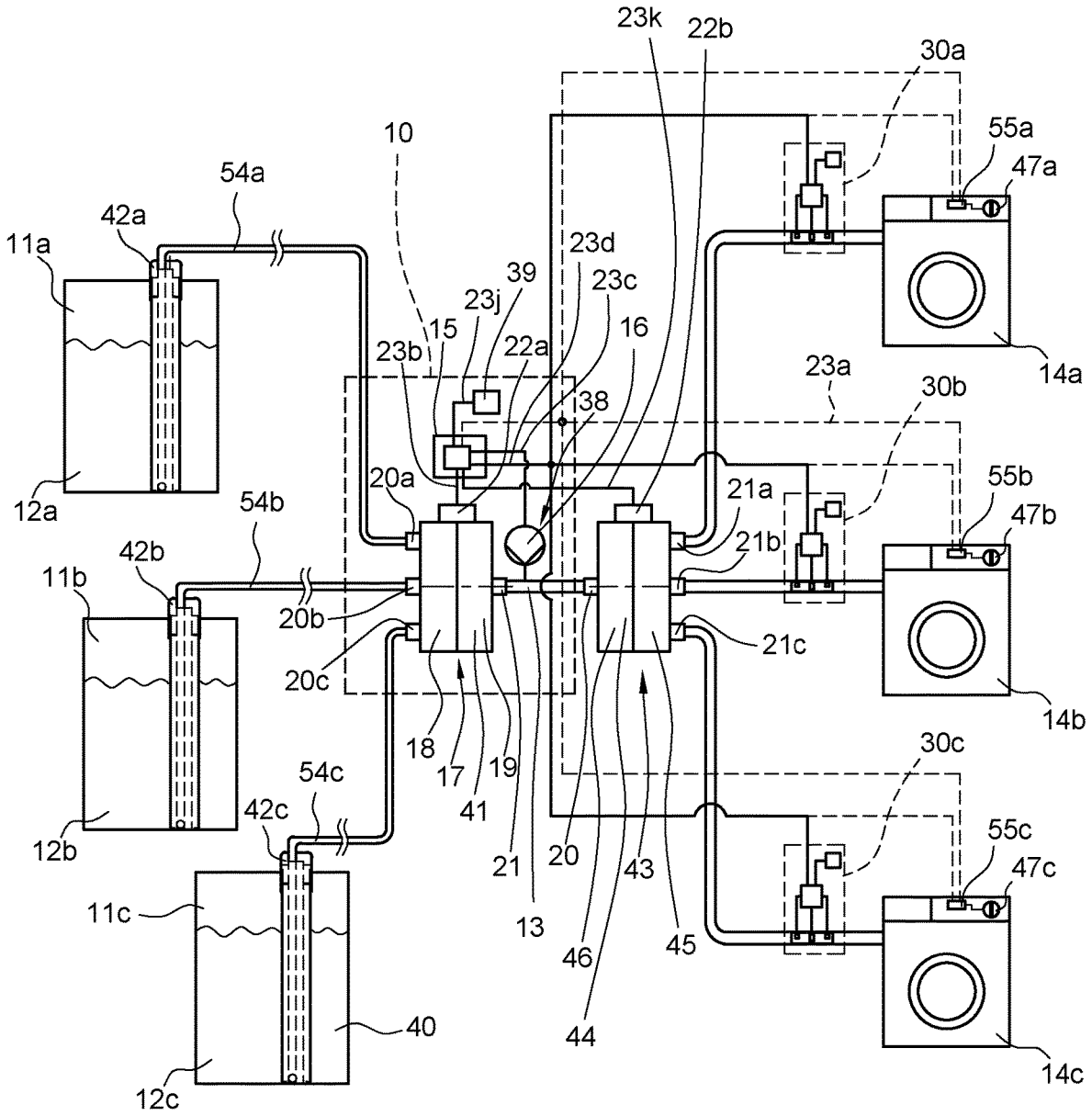
Figure 10:
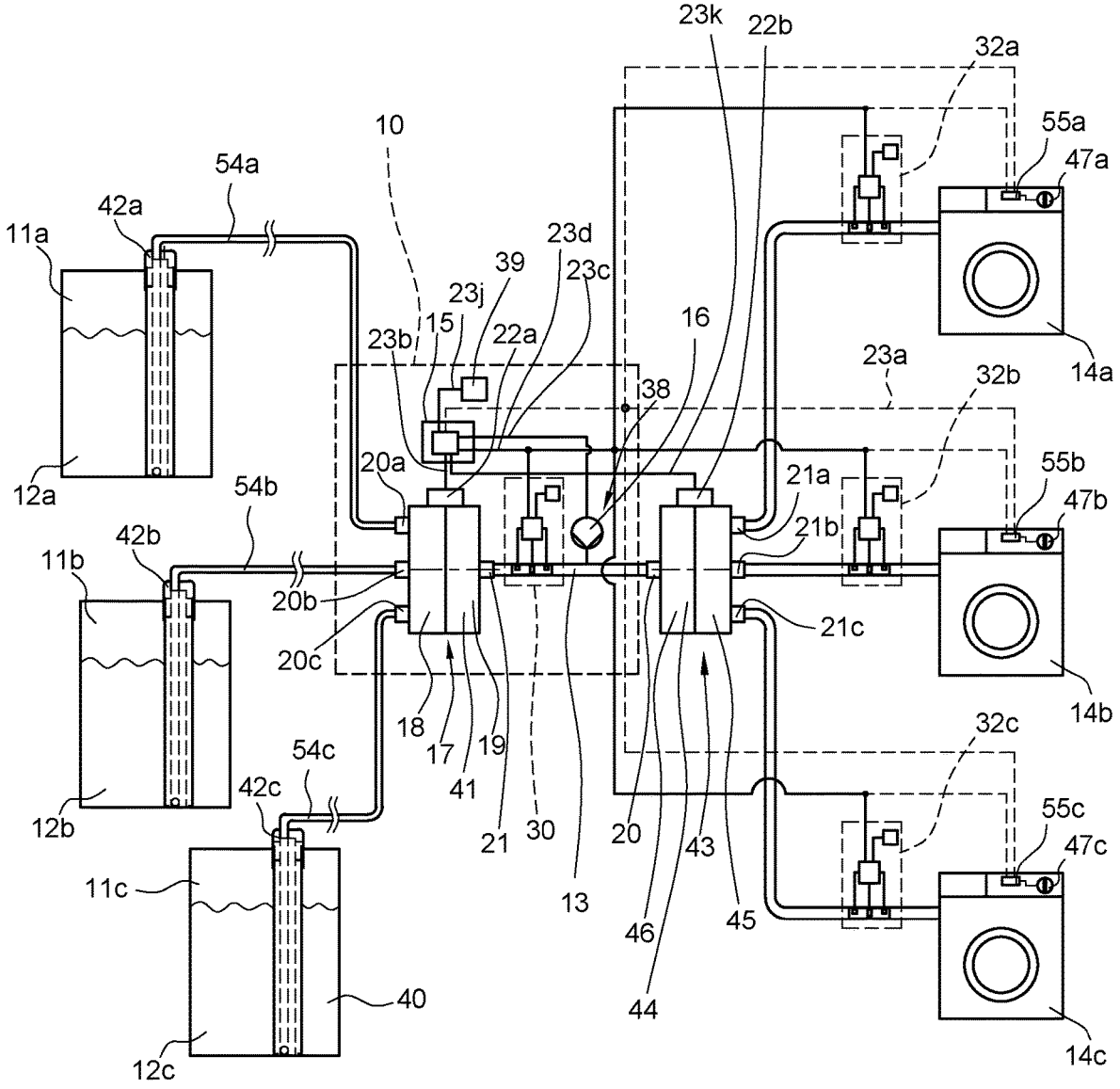
Figure 11:
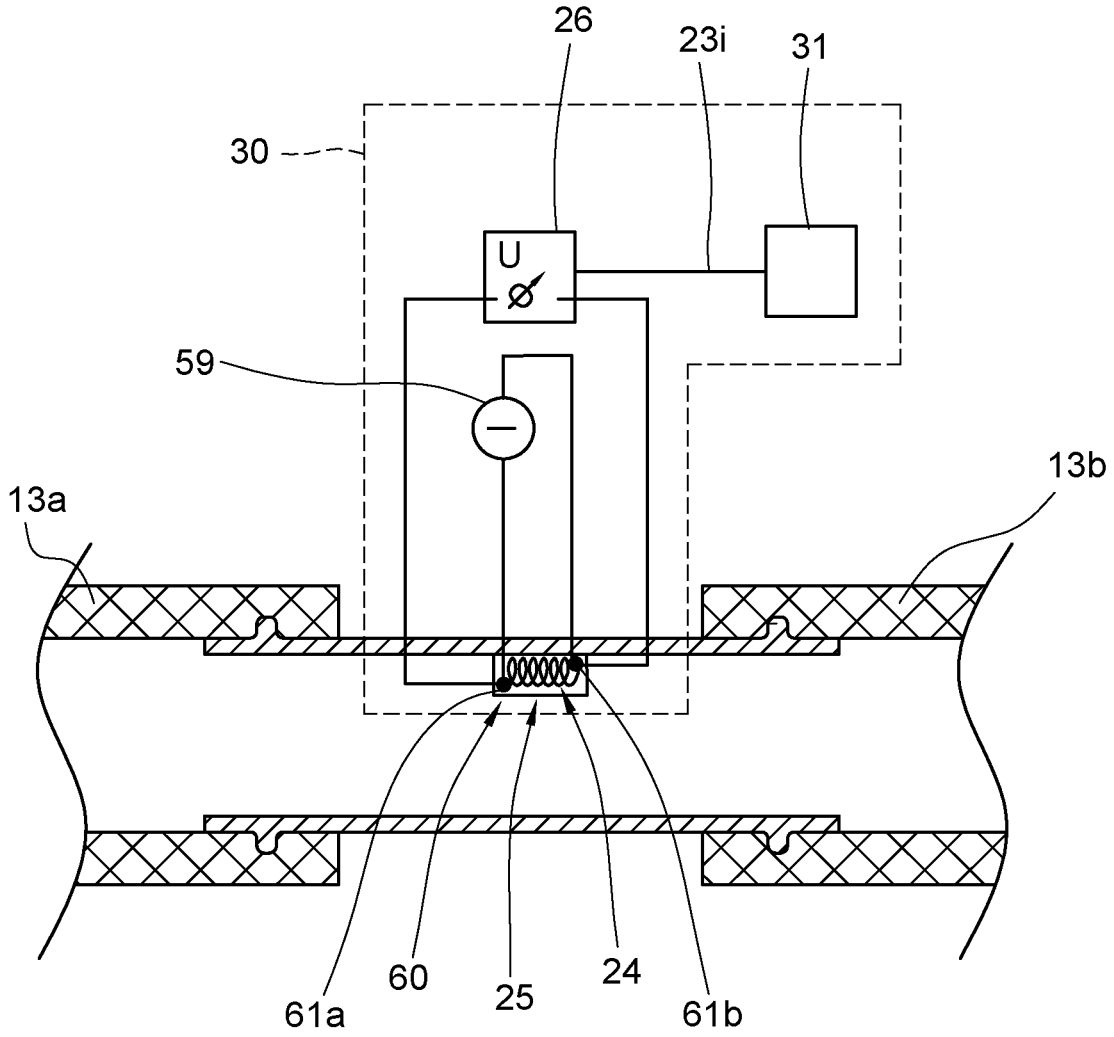
Figure 12:
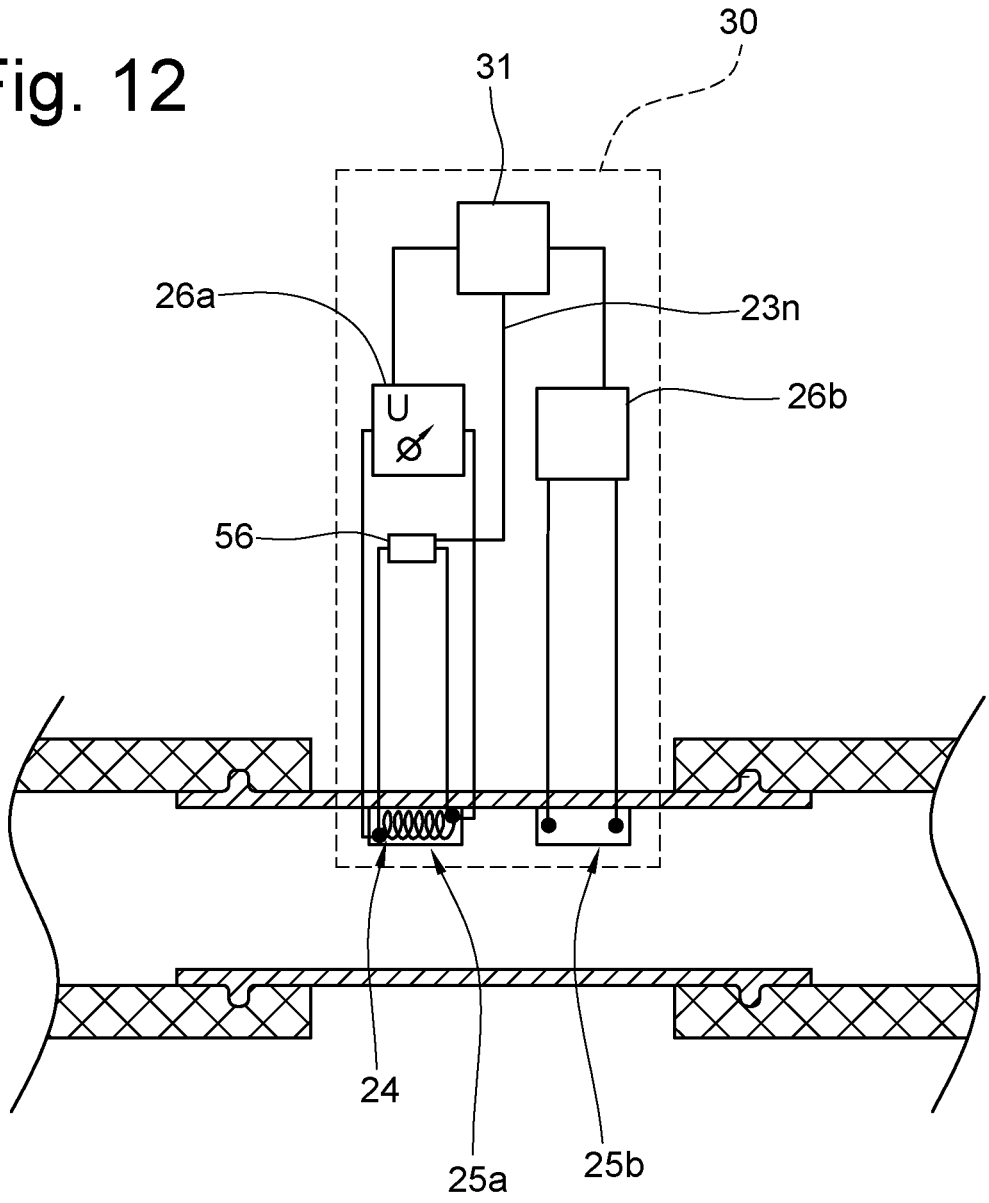
Figure 13:
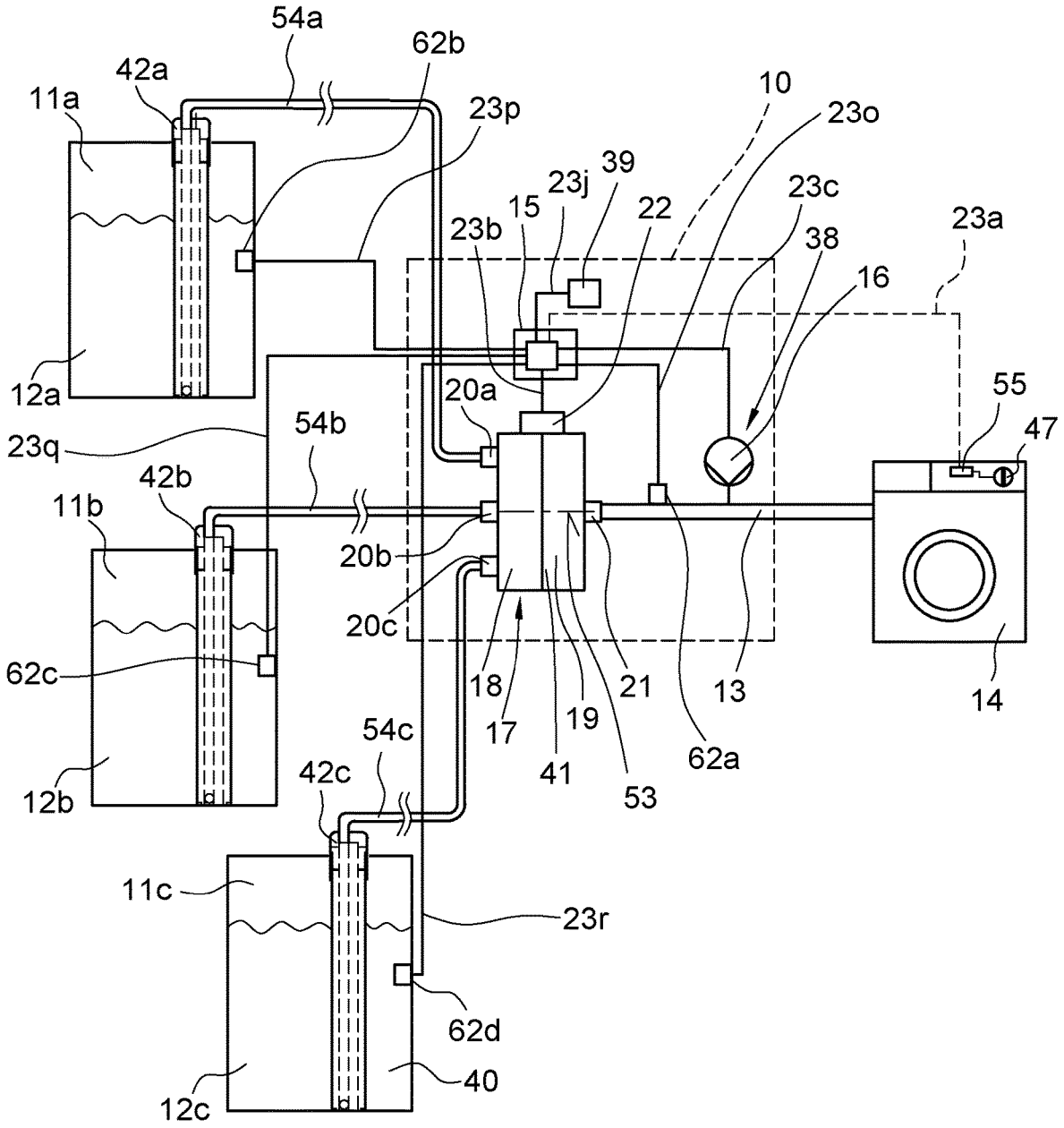
Figure 14:
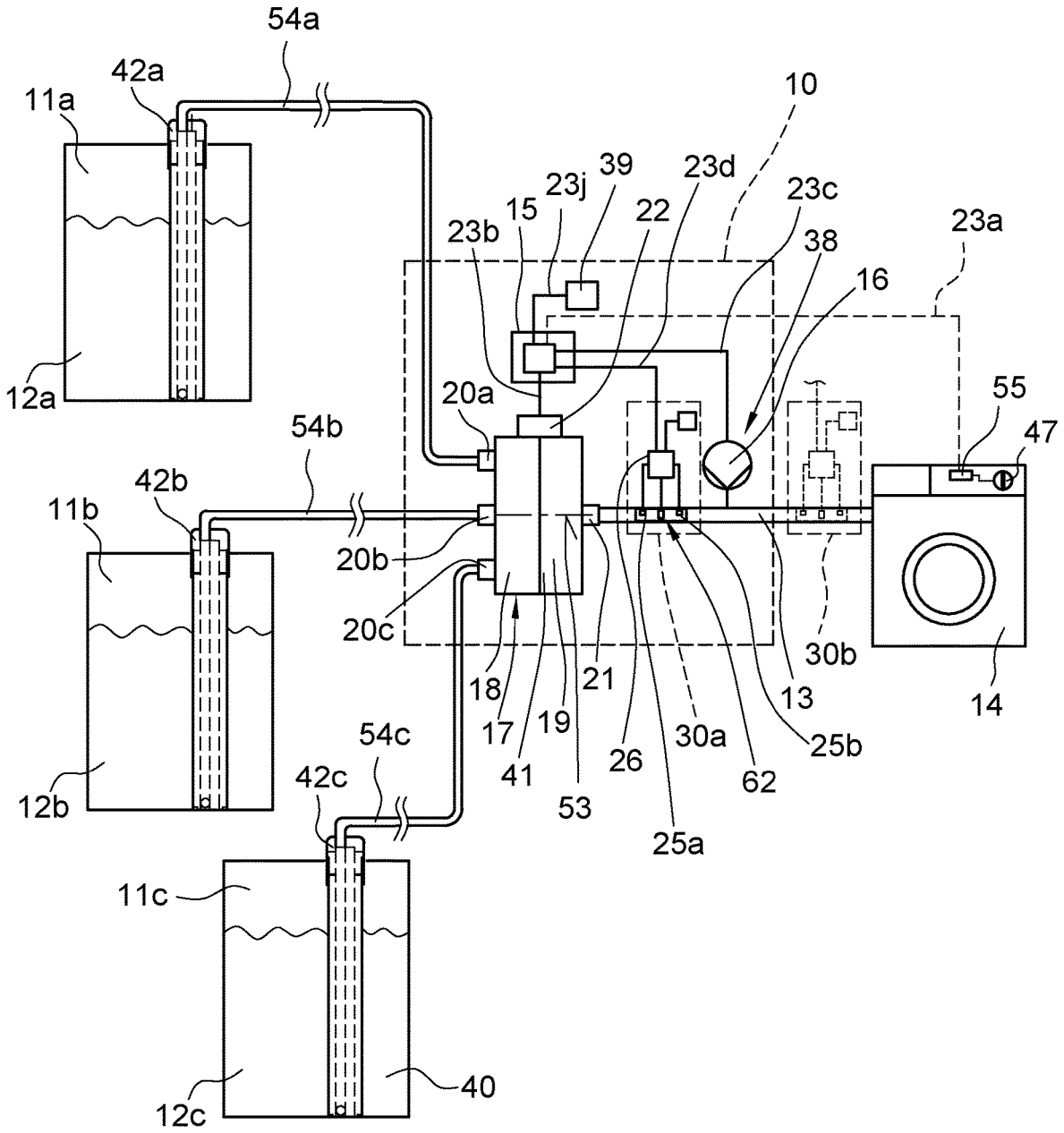

Further advantages of the invention will become apparent from the following description of the embodiments shown in the drawings. In the drawings:

FIG. 1 shows, in a partially sectional, block-diagram-like, schematic principle representation, a first exemplary embodiment of a metering device according to the invention with three containers connected on the input side and a target apparatus, FIG. 2*a* shows, in an enlarged schematic, partially sectional view, a first exemplary embodiment of an assembly unit arranged in a fluid line of the metering device of FIG. 1, said assembly unit comprising a heating element and two temperature sensors, FIG. 2*b* shows, in a representation according to FIG. 2*a*, a second exemplary embodiment of an assembly unit for use in a metering device according to the invention, in which the heating element is arranged on a wall opposite the wall on which the two temperature sensors are arranged, FIG. 2*c* shows a further exemplary embodiment of an assembly unit to be used in a metering device according to the invention in a representation according to FIG. 2*a*, wherein here the heating element and the two temperature sensors are recessed in the wall of the assembly unit, FIG. 3 shows a representation of a temporal behavior of a measurement value or a signal, which is to be understood as a differential signal of the measurement values detected by the two temperature sensors, in a first exemplary embodiment, wherein a first signal behavior is shown in solid lines and a second signal behavior of different amplitude and different time duration is shown in dashed lines, FIG. 4 shows, for another application situation in a representation according to FIG. 3, a changed temporal signal behavior, FIG. 5 shows, in a representation according to FIG. 3 for a changed application situation, a different temporal signal behavior, FIG. 6 shows another exemplary embodiment of a metering device according to the invention in a representation according to FIG. 1, wherein only a single container is connected on the input side of the metering device, FIG. 7*a* shows a schematic representation of a measured signal behavior in a first application situation, FIG. 7*b* shows, in a representation according to FIG. 7*a*, a second signal behavior corresponding to a second application situation, FIG. 7*c* shows, in a representation according to FIG. 7*a*, a third signal behavior in a third application situation, FIG. 7*d* shows, in a representation according to FIG. 7*a*, a fourth signal behavior in a fourth application situation, FIG. 8*a* shows, in a representation according to FIG. 7*a*, a fifth signal behavior in a fifth application situation, FIG. 8*b* shows, in a representation according to FIG. 7*a*, a sixth signal behavior in a sixth application situation, FIG. 8*c* shows, in a representation according to FIG. 7*a*, a seventh signal behavior in a seventh application situation, FIG. 8*d* shows, in a representation according to FIG. 7*a*, an eighth signal behavior in an eighth application situation, FIG. 9 shows, in a representation according to FIG. 1, a further exemplary embodiment of a metering device according to the invention, to which three target apparatus are connected on the output side, wherein a second mixture distribution device is provided, which switches the communication paths to the different target apparatus, FIG. 10 shows another exemplary embodiment of a metering device according to the invention in a representation according to FIG. 9, FIG. 11 shows, in a representation similar to FIG. 2*a*, a further exemplary embodiment of an assembly unit arranged on a metering device, with a heating element and a temperature sensor, wherein the heating element and the temperature sensor are of integrated configuration and are activated by a constant current source, FIG. 12 shows another exemplary embodiment of an assembly unit with a heating element and two temperature sensors, FIG. 13 shows an exemplary embodiment of a metering device according to the invention in a representation similar to FIG. 1, in which the control unit is configured to take temperature information into account when carrying out a metering process or when calibrating the pump, and FIG. 14 shows a further exemplary embodiment of a metering device according to the invention, in which a temperature measuring device transmits temperature information about the medium to the control unit, wherein information about a performed conveyance of the medium which can be determined at the same time from the measurement values obtained from the temperature measuring device.

Exemplary embodiments of the invention are described by way of example in the following figure description, also with reference to the drawings. For the sake of clarity, like or comparable parts or elements or areas are denoted by like reference signs, sometimes with the addition of small letters—even where different exemplary embodiments are concerned.

Features described only in relation to one exemplary embodiment may also be provided in any other exemplary embodiment of the invention within the scope of the invention. Such modified exemplary embodiments—even if not shown in the drawings—are included in the invention.

All disclosed features are essential to the invention in themselves. The disclosure of the application hereby also includes the full disclosure content of the associated priority documents (copy of the prior application) as well as the cited publications and the described prior art devices, also for the purpose of including individual or several features of these documents in the present application.

A first exemplary embodiment of a metering device according to the invention is denoted in its entirety by 10 in FIG. 1.

Three containers 11*a*, 11*b*, 11*c* are connected to the metering device 10 on the input side and are each filled with a medium 12*a*, 12*b*, 12*c*. A suction lance 42*a*, 42*b*, 42*c* is immersed in each of the containers 11*a*, 11*b*, 11*c* and is connected to an input 20*a*, 20*b*, 20*c* of a mixture distribution device 17 via a supply line 54*a*, 54*b*, 54*c*. The mixture distribution device 17 comprises an input disc 18 and an output disc 19 rotatable about an axis of rotation 53. A motor 22 is provided to rotate the output disc 19, which acts as an actuator or actuating element 41. The motor 22 can be activated by a control unit 15 of the metering device 10 via a signal line 23*b*.

The mixture distribution device 17 has an output 21 to which a fluid line 13 is connected. The fluid line 13 leads to a target apparatus 14 (see for example FIG. 1). In the exemplary embodiment of FIG. 1, the target apparatus is a commercial washing machine or a household washing machine 14.

In different rotational positions of the actuator 41, a particular one of the inputs 20*a*, 20*b*, 20*c* is connected to the output 21, and the remaining inputs 20*a*, 20*b*, 20*c* are closed. In this way, the mixture distribution device 17 switches the communication paths between the containers 11*a*, 11*b*, 11*c* and the fluid line 13.

The washing machine 14 comprises a program selector switch 47, which is connected to a control apparatus 55 on the target apparatus 14. The control apparatus 55 of the target apparatus 14 is connected to the control unit 15 on the metering device 10 via a signal line 23*a* shown in dashed lines.

The metering device 10 additionally comprises a pump 16, which is also connected to the control unit 15 via a signal line 23*c*.

When a washing program is set by an operator at the target apparatus 14 via the program selector switch 47, the control apparatus 55 can send a request for a specific medium to the control unit 15 via the signal line 23*a*. In particular, the control unit 15 receives a request to deliver a predetermined amount of a predetermined medium to the target apparatus 14 at a specific time. For this purpose, the control unit 15 can first activate the motor 22 to actuate the actuating element 41 to switch the desired communication path so that the corresponding medium 12*a*, 12*b*, 12*c* can be conveyed. Next, the control unit 15 can activate the pump 16 to operate for a predetermined period of time or for a predetermined number of revolutions to thereby deliver a predetermined amount of medium. Subsequently, the fluid line 13 can be rinsed.

For the purpose of rinsing, the control unit can again activate the motor 22 so that the actuator 41 is shifted to another rotational position and can connect an input 20*a*, 20*b*, 20*c*, connected to a container with rinsing medium, to the output 21. The pump 16 can then be activated again by the control unit 15 to deliver rinsing medium.

According to the invention, in the metering device 10 according to FIG. 1, an assembly unit 30*a* is provided which, as shown in FIG. 2*a*, comprises in accordance with the invention a heating element 24 and at least one temperature sensor 25, preferably a pair 27 of temperature sensors 25*a*, 25*b*. In addition, the assembly unit 30, 30*a* comprises a measuring device 26.

According to FIG. 1, the assembly unit is denoted by 30*a* and is arranged in the flow path between the mixture distribution device 17 and the pump 16. The assembly unit 30*a* is therefore arranged upstream of the pump 16.

FIG. 1 additionally shows an alternative embodiment in dashed lines, according to which an assembly unit 30*b* with the same or identical construction can be arranged downstream of the pump 16. However, also in this alternative embodiment, the assembly unit 30*b* is assigned to the metering device 10. In particular, the assembly unit is part of the metering device 10.

In the following, the structural design and architecture of such an assembly unit 30, 30*a*, 30*b* will be explained with reference to the exemplary embodiment of FIG. 2*a:*

FIG. 2*a* shows a schematic diagram of an assembly unit 30 comprising a heating element 24, a first temperature sensor 25*a*, and a second temperature sensor 25*b*. The heating element 24 projects into the interior of the fluid line 13.

It should be noted that the assembly unit 30 provides a pipe section 57 which has two hose connection ends 48*a*, 48*b* for connecting corresponding portions 13*a*, 13*b* of the fluid line. For example, a circumferential rib may be provided on the pipe section 57 for this purpose. This allows the hose ends 13*a*, 13*b* to be clamped and mechanically fixed in a simple manner.

Of course, other types of fastening are also comprised by the invention.

It should be noted that, in the exemplary embodiments according to FIGS. 2*a* and 2*b*, the heating element 24 and the temperature sensors 25*a*, 25*b* partially protrude into the fluid flow; however, this geometry is only to be understood schematically.

In fact, in some exemplary embodiments, the invention will seek to arrange both the heating element and the temperature sensors flush or substantially flush with a wall of the pipe section 57, or even recessed with respect thereto, so as in any event not to interfere with the fluid flow.

On the other hand, projecting these elements 24, 25*a*, 25*b* into the fluid flow may well be desired in other exemplary embodiments, for example in order to ensure turbulence in the region of the temperature measurements and also for equalization of the fluid flow over the entire cross-section of the fluid line 13.

FIG. 2*a* shows that the two temperature sensors 25*a*, 25*b* are arranged symmetrically with respect to the heating element 24. The distance 29*a* between the temperature sensor 25*a* arranged upstream of the heating element 24 and the heating element 24 is the same as the distance 29*b* of the heating element 24 from the temperature sensor 25*b* arranged downstream.

The symmetrical geometry has the effect that when the medium is at a standstill, i.e. when no medium is being conveyed, the heat flow generated by the heating coil 49 or other heating apparatus is distributed evenly over the two temperature sensors 25*a*, 25*b*, so that, due to the identical distance 29*a*, 29*b* from the two sensors 25*a*, 25*b*, the same or substantially the same heat input is also measured by each of the two sensors 25*a*, 25*b*.

As soon as the pump 16 conveys medium, a medium flow indicated by the arrow P is created within the assembly unit 30. This results in the temperature sensor 25*a* arranged upstream no longer being able to measure any thermal energy generated by the heating element 24 due to the heat entrainment, or at least being able to measure only a considerably lower thermal energy than the temperature sensor 25*b* arranged downstream.

Under consideration of a differential signal, therefore no signal or almost no signal can be measured when the medium is at a standstill, and a clear signal can be measured after the pump drive has been switched on.

The exemplary embodiment of FIG. 2*b* has a modified symmetrical arrangement in which the heating element 24 is arranged on one wall of the assembly unit 30 and the two temperature sensors 25*a*, 25*b* are arranged on the opposite wall.

The exemplary embodiment of FIG. 2*c* is intended to illustrate that the temperature sensors 25*a*, 25*b* and/or also the heating element 24 can also be integrated directly into the wall of the pipe section 57 and, for example, can also arranged flush therewith.

For this purpose, the pipe section can have window-like openings in its wall area, although these are not shown in FIG. 2*c*.

According to FIG. 2*a* (—but also according to FIGS. 2*b* and 2*c*—), the assembly unit 30 comprises a heating controller 56, which ensures that the heating element 24 is activated continuously or in a clocked fashion or irregularly or, as the case may be, according to specific specifications and causes a corresponding heat input into the medium present or conveyed within the fluid line 13. The heating controller 56 is connected to a measuring device 26 via a signal line 23*f*. The measuring device 26 is additionally connected to the temperature sensors 25*a*, 25*b* via corresponding signal lines 23*g* and 23*h* and can receive corresponding measurement values from there.

The measuring device 26 can have a computer unit 31 or can be connected to a computer unit 31 via a signal line 23*i*.

The measuring device 26 is capable of signal processing or signal pre-processing the values output by or obtained from the two temperature sensors 25*a*, 25*b*.

In particular, the measuring device 26 can determine a difference between the values output by the two temperature sensors 25*a*, 25*b*. This difference value contains, in particular, information about whether medium has been conveyed through the assembly unit 30, and, in particular, also provides information about the volume of medium conveyed and the type of medium conveyed.

FIG. 3 is intended to illustrate an exemplary embodiment of a measurement in a first application situation:

The temporal course (time t) is plotted on the X-axis.

A measurement value ΔV corresponding to a result of a differential measurement is plotted on the Y-axis. This is only an example of a differential measurement value, assuming that temperature measurement values are output in volts.

This measurement value ΔV is therefore only intended as an example of an arbitrary differential measurement value.

Only the basic temporal behavior of the signal is decisive.

It is assumed that a pump 16 of a metering device 10 is switched on at a time $t_0$. Then, differential values ΔV of zero or approximately zero are to be measured at time periods before this time $t_0$. This is a differential measurement signal which takes into account that the same temperatures are measured at both temperature sensors 25*a*, 25*b* of the exemplary embodiment of FIG. 2*a* due to the symmetrical embodiment of the assembly unit 30.

Consequently, the waveform of the differential measurement value ΔV of FIG. 3 for time periods $t<t_0$ shows a differential measurement value $V_0$, i.e. a kind of offset value.

This can be zero or approximately zero—depending on the actual scale to be used—or in any case can be a small, substantially constant value. The value can also be subject to a certain amount of noise, as will be made clear later with the help of other actual measured values.

If, at the time to, the pump 16 is activated to deliver a predetermined amount of medium, this causes the differential signal ΔV according to FIG. 3 to rise sharply in accordance with a signal edge 51, up to a value $V_1$. The difference between $V_1$ and $V_0$ is referred to as the amplitude $A_1$.

If, at a time $t=t_1$, the pump 16 is then switched off and thus stopped, some medium still flows. The signal ΔV corresponding to the signal falling edge 52 then drops, for example until a time $t_3$, at which the starting value $V_0$ is reached again.

The waveform shown in the figures is to be understood as merely schematic and illustrative.

An actually measured signal can also deviate in its signal form from the waveforms shown in the drawings.

The signal can include a statement about the amount of medium conveyed. In particular, the signal can be integrated. The area under the curve in FIG. 3 should be proportional to the flow rate, or should at least be in relation to the flow rate.

On the other hand, a statement about the duty cycle of the pump and the type of medium can be deduced from the signal form, which can be data-analyzed In dashed lines, FIG. 3 shows a second waveform 33*b*, which is used for example for a different medium, for example one with a different viscosity.

However, the dashed line 33*b* in FIG. 3 can also represent a waveform for a conveyance of the same medium with a different pump delivery capacity.

It is assumed that the pump was switched on again at the time $t=t_0$ for this medium as well. In this case, a changed signal rising edge 51*b* can be recognized in the curve of the signal 33*b* according to FIG. 3, either because a different medium was conveyed or because the pump provides a different delivery capacity.

When looking at FIG. 3 and the waveform of the signal 33*b*, it is clear that a changed maximum differential measurement value $V_2$ is achieved, and thus a greater amplitude $A_2=V_2-V_0$ is achieved than with the first medium.

Lastly, the pump is switched off at a different time, namely at the time $t=t_2$. Another signal falling edge 52*b* is generated, which is denoted 52*b* in FIG. 3.

From these different waveforms, different signal edges 51, 51*b*, 52, 52*b* and the different amplitudes $A_1$, $A_2$, conclusions can be drawn about the viscosity of the conveyed medium or the type of medium. Information about the conveyed fluid volume can also be obtained from the different waveforms 33*a*, 33*b*.

FIG. 4 shows, in another application situation, a waveform 33*c* corresponding to FIG. 3 and a further waveform 33*d*, which takes into account a longer switch-on time of the pump 16 with the same medium. While in the case of waveform 33*c* the pump is switched off at the time $t=t_1$, in the application situation according to waveform 33*d* the pump is only switched off at the time $t=t_2$.

The flow rate can also be deduced from this signal shape. Again, by integration, i.e. by determining the area under the waveform, a statement about the conveyed volume can be obtained.

FIG. 5 again shows two different signal shapes, wherein the signal shape 33*e* corresponds to the signal shape 33*a*, and wherein a different signal shape 33*f* is obtained for a different medium. The signal rising edges 51, 51*f* and the signal falling edges 52, 52*f* differ significantly due to the different viscosities and the different media, possibly also due to the different heat capacities and/or the different heat conduction properties of the media used.

It remains to be noted that information can be derived on the basis of the measured waveforms of measurement values, in particular of differential measurement values, which originate from temperature sensors and can be subjected to signal processing: Thus, on the basis of signal shapes or signal contours, signal rising edges, signal falling edges, signal amplitudes, signal lengths, and signal swept areas, as well as on the basis of later periodicities or pulsations in the waveform, which are yet to be explained, a variety of information can be obtained about the conveyed volume and the type of conveyed medium.

The control unit can also relate this information to information that is already available in the control unit, for example regarding the type of medium being conveyed or the target flow rate. This allows verifications, checks and determinations of various kinds to be carried out.

FIGS. 7*a* to 8*b* show different signal patterns for different media, with different viscosities or with different heat capacities and different pump capacities. Different periodicities, different amplitudes and different signal shapes can be seen, including different waveforms, such as signal rising edges and signal falling edges.

The measurement values, in particular the measured signals, allow information to be determined. The determination of information can be carried out by the measuring device 26 or by the control unit 15 of the metering device 10. In any case, information, as far as it is determined by the measuring device 26, can be transmitted to the control unit of the metering device.

In the following, the measured waveforms of FIGS. 7*a* to 8*d* will be explained in more detail:

The schematically represented waveforms 58*a*, 58*b*, 58*c*, 58*d*, 58*e*, 58*f*, 58*g*, 58*h* of FIGS. 7*a* to 8*d* correspond to the representations which are visible on an oscilloscope when a differential measurement value is measured at an assembly unit 30, 30*a*, 30*b*, 32*a*, 32*b*, 32*c*.

FIGS. 7*a* to 7*d* correspond to the differential measurement values of measurements of a first medium, wherein the same pump is used in each case, but different pump delivery capacities have been set. For example, FIGS. 7*a* to 7*d* illustrate different rotational speeds or rotational rates of a peristaltic pump. Thus, FIG. 7*a* can be regarded as an example of a waveform 58*a* of a pump with a delivery capacity of only 25%, FIG. 7*b* for a delivery capacity of 40%, FIG. 7*c* for a delivery capacity of 85%, and FIG. 7*d* for a delivery capacity of 95%.

FIGS. 8*a* to 8*d* in turn illustrate the signal behavior for comparable different delivery capacities for a medium with a different viscosity compared to FIGS. 7*a* to 7*d*.

In any case, the following can be seen when comparing the waveforms: On the one hand, the waveforms are all or almost all periodic: The period duration is marked as $T_1$, $T_2$, $T_3$, $T_4$ etc., respectively.

The waveform of FIG. 7*a* has a periodicity $T_1$. The time interval between the times $t_1$ and to is exactly the same as the time interval between the waveform minima at the points in time $t_2$ and $t_1$ or $t_3$ and $t_2$.

It can also be seen that the period duration is shortened due to higher pump speeds—and thus is associated with a greater delivery capacity of the pump. Assuming that the time axis in FIGS. 7*a* to 7*d* is constant, the transition from FIG. 7*a* via FIG. 7*b* to FIG. 7*c* and to FIG. 7*d* shows an increasing shortening of the period duration with increasing speed of the pump 16.

The waveform with minima and maxima can be explained by the press behavior of the rolls or rollers of a peristaltic pump, which has a pair of press rollers arranged oppositely over 180°. This results in a certain pulsation 37, which is imposed on the fluid flow during operation of the peristaltic pump and which is also shown in the signal pattern of FIGS. 7*a* to 7*d*.

It should be noted that a differential measurement value is entered on the Y-axis in FIGS. 7*a* to 8*d* and is plotted in the unit of millivolts, for example. It is clear to a person skilled in the art that this can be an arbitrary variable, but one that is related to a differential measurement value and proportional thereto.

FIGS. 7*a* to 7*d* illustrate that the amplitudes can also change. In particular, FIG. 7*a* illustrates an amplitude $A_2$ between minimum and maximum and FIG. 7*b* an amplitude $A_1$, which is lower in comparison and which is further reduced with respect to FIG. 7*c* and FIG. 7*d*, denoted there as $A_1$ and $A_2$, respectively.

Lastly, the contour of the waveform also changes.

From the waveforms according to FIGS. 8*a* to 8*d* it can also be seen that both changed periodicities $T_5$, $T_6$, $T_7$ and different amplitudes $A_3$, $A_4$, $A_5$, $A_6$ result at different delivery capacities of the pump for this second medium used in the measurements according to FIGS. 8*a* to 8*d*.

The metering device 10 has a memory 39 which is part of the control unit 15 or is connected thereto via a signal line 23*j*. Various values can be stored in the memory 39. The values can include waveforms or signal patterns or signal properties for different delivery capacities of the pumps and/or for different types of media and/or for different viscosities and/or for different delivery quantities.

The control unit 15 can determine what quantity of medium was conveyed, whether the correct quantity of medium has been conveyed, what medium has been conveyed, or whether the correct medium has been conveyed by comparison with waveforms 33*a*, 33*b*, 33*c*, 33*d*, 33*e*, 33*f*, 33*g*, 33*h* measured at the assembly unit 30 and the stored values, in particular signal patterns or waveforms.

The exemplary embodiment of FIG. 6 corresponds to the exemplary embodiment of FIG. 1, wherein only one container 11 is connected on the input side to the metering device 10 of FIG. 6.

Again, the exemplary embodiment of FIG. 6 illustrates two different positions for the assembly unit 30*a*, 30*b*, wherein these can be arranged either upstream of the pump 16 or downstream of the pump 16.

The exemplary embodiment of FIG. 9 illustrates a metering device 10 according to the invention, to which three target apparatuses 14*a*, 14*b*, 14*c* are connected on the output side, wherein the metering device 10 has a second mixture distribution device 43, with an input disc 44 acting as an actuating element 46 and with an output disc 45. Here, the input disc 44 can be rotationally driven by a motor 22*b* and can optionally establish different communication paths between the input 20 and the three outputs 21*a*, 21*b*, 21*c* of the output disc 45.

To avoid repetition, reference is also made to patent application EP 2 783 142 A2 with regard to this exemplary embodiment.

In the exemplary embodiment of FIG. 9, each target apparatus 14*a*, 14*b*, 14*c* is assigned to an assembly unit 30*a*, 30*b*, 30*c*. Each of the assembly units 30*a*, 30*b*, 30*c* is connected either to the control unit 15 of the metering device 10 and/or to a control apparatus 55 of the corresponding target apparatus 14*a*, 14*b*, 14*c*.

Here, the assembly unit 30*a*, 30*b*, 30*c* serves to provide a POD signal. This is important, for example, for certain washing or cleaning programs. It can also be used for documentation purposes in order to permanently ensure that proper metering has been performed at certain times.

FIG. 10 shows a further exemplary embodiment of a metering device according to the invention, following the exemplary embodiment of FIG. 9: Here, in addition to the assembly units 30, an additional assembly unit 32*a*, 32*b*, 32*c* is provided on the metering device 10 directly upstream of each of the target apparatuses 14*a*, 14*b*, 14*c*.

In one exemplary embodiment, assembly units 32*a*, 32*b*, 32*c* are configured to generate a POD (proof-of-delivery) signal. This signal can either be transmitted to the relevant control apparatus 55*a*, 55*b*, 55*c* of the corresponding target apparatus 14*a*, 14*b*, 14*c* or to the control unit 15 of the metering device 10 via the connection line shown in solid lines in FIG. 10.

In the following, a series of exemplary embodiments of methods according to the invention will be explained:

In a first exemplary embodiment, it is assumed with regard to the metering device of FIG. 1 that the assembly unit 30*a* measures a differential measurement value with a waveform approximately according to FIG. 7*c* for a predetermined period of time t after the pump 16 has been operated. From this information, the measuring device 26, possibly with the computer unit 31 connected thereto or in cooperation with the control unit 15, can determine what flow rate was pumped through the fluid line 13 by the pump 16. Such a determination can be performed, for example, by signal processing, in particular by integrating the signal according to FIG. 7*c*.

After determining this flow rate, this information can be used further by the control unit. For example, the delivered quantity of medium can be reported to the target apparatus or documented. It can also be compared with a request signal and the target flow rate. In this way, the control unit can check whether the metering process has been carried out properly. In the event of a discrepancy between the target flow rate and the determined or calculated flow rate, a warning signal can be emitted or a malfunction message can be triggered, for example.

In a second exemplary embodiment, a measurement signal is recorded according to FIG. 8*b*. The periodicity of the signal, or signal shape, or the waveform, for example the amplitudes, the signal rising edges, the signal falling edges, the signal contours, can be checked to see whether the correct medium has been conveyed by comparison with corresponding values arranged in the memory 39. These values are dependent specifically on the medium or viscosity. The control unit 15 may have previously obtained information as to which media have been connected to which inputs 20*a*, 20*b*, 20*c* of the metering device 10. After receiving a request signal from the target apparatus 14 and a response from the motor 22, the control unit knows which media 12*a*, 12*b*, 12*c* should be conveyed. By comparison with the values obtained from the assembly unit 30, 30*a*, 30*b* and with recourse to the values stored in the memory 39, it can be determined by the control unit during a verification whether the measured waveform corresponds to an expected waveform or deviates therefrom.

In the event of deviations, for example, a warning signal, a fault message or similar can be generated or initiated.

In a third embodiment, it is possible to check whether the pump 16 is still capable of conveying the target delivery quantities by measuring the waveform and determining the delivered quantity of medium on that basis. If necessary, the measured and determined flow rate values can be used to recalibrate the pump.

According to a further advantageous embodiment of the invention, it is provided that the assembly unit 30, 30*a*, 30*b* has an internal computer unit 31 with which signal processing can be performed. The signal processing can be based on the fact that values determined by the different temperature sensors 25*a*, 25*b* are subjected to a comparative consideration.

In a particular exemplary embodiment of the invention, it is provided that these considerations and calculations for optimizing the measurement results are carried out with different parameter sets. In particular, adaptations of the parameter sets to different media are provided according to the invention, wherein the media have, for example, different viscosities or different heat capacities.

Accordingly, in an exemplary embodiment of the invention, it is provided that the metering device 10, with the aid of the control unit 15, in knowledge of the medium 12*a*, 12*b*, 12*c* to be conveyed and in cooperation with the computer unit 31 of the assembly unit 30, 30*a*, 30*b*, transmits parameter sets or calculation parameters adapted to the medium 12*a*, 12*b*, 12*c* conveyed in this individual case.

Nevertheless, it is comprised by the invention if the assembly unit 30, 30*a*, 30*b* only supplies raw values and the corresponding signal processing and calculation is carried out by the control unit 15 or by a computer unit connected to the control unit 15.

FIG. 11 shows an exemplary embodiment of an assembly unit 30 of a metering device 10 according to the invention in a representation comparable to FIG. 2*a*, in which only a temperature sensor 25 and a heating element 24 are provided. In this exemplary embodiment, the temperature sensor 25 and the heating element 24 are integrated and combined to form an NTC component. NTC (=Negative Temperature Coefficient) components comprise a heatable resistor which exhibits a temperature-dependent resistance behavior. An NTC component is shown by way of example in the exemplary embodiment in FIG. 11, wherein it could alternatively be a PTC component.

The component 30 according to FIG. 11 comprises a constant current source 59. This supplies a constant current to the NTC component 60. The circuit, not shown, of the constant current source 59 can comprise a power limiter.

The current flowing through the component 60 heats the component or the resistor on account of ohmic heat. This causes the component 60 to reach a certain temperature.

As a measure of the electrical resistance R of the component 60, the voltage U dropping across the resistor can be measured. For this purpose, the input 61*a* and the output 61*b* of the component 60 are connected to the measuring device 26, which can carry out a voltage measurement.

When the medium 12 is stationary in the fluid line 13, the voltage to be measured is constant or almost constant. If the pump 16 responds and the medium 12 is conveyed through the fluid line 13, the medium 12 entrains thermal energy so that the temperature of the component 60 decreases. This leads—depending on whether the component 60 is an NTC element or a PTC element—to an increasing or decreasing resistance of the component 60. The change to the resistance R of the component 60 is expressed in a corresponding voltage change U. The measurement signal received by the measurement electronics 26 can thus in turn comprise information regarding the fluid conveyance through the fluid line 13.

Further exemplary embodiments, not shown, are comprised by the invention, comprising a plurality of electronic components 60 with NTC or PTC components.

The invention also comprises a situation when more than two heating elements 24 and/or more than two temperature sensors 25*a*, 25*b* are provided along the fluid line 13. For example, when using media of which the flow can easily break away when conveyed, it has proven to be advantageous if a measurement is carried out along a plurality of measurement points, i.e. along a plurality of temperature sensors that are spaced apart from each other, and a mean value formation is performed along different measurement points.

It is also comprised by the invention if a measuring circuit is used which comprises a plurality of temperature-dependent resistors as temperature sensors, which are connected in series, for example.

The exemplary embodiment of FIG. 12 shows an assembly unit 30 with a first temperature sensor 25*a* and with a second temperature sensor 25*b*.

The first temperature sensor 25*a* comprises a heating element 24 which is activated by a heating controller 56.

The two temperature sensors 25*a*, 25*b* can be of any configuration. For example, they can each have a temperature-dependent, measurable resistance. In the exemplary embodiment of FIG. 12, the temperature sensor 25*a* is connected to a first measuring device 26*a* via a measuring circuit and the temperature sensor 25*b* is connected to a measuring device 26*b* via an analogue measuring circuit. Both measuring devices 26*a*, 26*b* are connected to a computer unit 31 of the assembly unit 30.

The computer unit 31 is in turn connected to the heating controller 56 via a signal line 23*n*.

In this exemplary embodiment, it can be provided that the heating element 24 is actuated in such a way that a constant temperature difference is always measured between the two temperature sensors 25*a*, 25*b*.

For example, a first temperature T1 can be measured at the temperature sensor 25*a*, said first temperature differing by a constant amount, for example by 5 degrees Celsius, or by 10 degrees Celsius, or by 15 degrees Celsius from a temperature T2 measured in the region of the second temperature sensor 25*b*.

The heating controller 56 attempts to keep this temperature difference, which may be adjustable, constant.

The measuring devices 26*a*, 26*b* can report the measured temperature values from the two temperature sensors 25*a*, 25*b* to the computer unit 31, and the computer unit can transmit a corresponding feedback signal to the heating controller 56 via the signal lines 23. This feedback signal leads to a readjustment of the heating control and thus to a heating of the heating element 24 in order to bring the possibly out-of-balance temperature difference back to a target value.

When the medium 12 is in the fluid line 13, the heating element 24 requires a certain supplied power or energy. If the medium 12 is conveyed through the fluid line 13 by the pump 16, in order to maintain a constant temperature difference ΔT between the two temperature sensors 25*a*, 25*b*, additional heat energy must be supplied. Thus, under the premise that a heating controller 56 attempts to keep the temperature difference ΔT between the two temperature measurement values constant, the supplied heating power or heat energy for the heating element can be a measure for the conveyance of medium 12 through the fluid line 13. This value can be used as a measurement value according to the invention.

The computer unit 31 is able to compare the temperatures calculated by the measuring devices 26*a*, 26*b* and to transmit a determined signal to the heating controller 56 via the signal line 23*n*. The measure of this actuation can also be used as a measurement value, for example.

It is also comprised by the invention if the heating power for the heating element is determined or measured elsewhere.

The exemplary embodiment of FIG. 12 shows a control of the heating controller 56 in the manner of a digital control. Other, analogue control circuits, not shown, are also comprised by the invention.

FIG. 13 will now be used to explain an exemplary embodiment of a metering device 10 which has a temperature measuring device 62 with which a temperature of at least one medium 12*a*, 12*b*, 12*c* can be measured, or with which a temperature of an environment of the metering device 10 can be measured. The temperature information about the measured temperature can be transmitted to the control unit 15 of the metering device 10. The control unit 15 is configured to take the information obtained about the temperature into account when actuating the pump 16 to carry out a metering process or when calibrating the pump 16.

In the exemplary embodiment of FIG. 13, an assembly unit 30 described on the basis of the exemplary embodiments of FIGS. 1 to 12 is not provided. In the exemplary embodiment of FIG. 13, according to a first variant, a temperature measuring device 62*a* is provided, which is arranged directly on the fluid line 13, or projects into it, or is provided at another, suitable location. The temperature measuring device 62*a* is configured to measure a temperature of the medium 12*a*, 12*b* and/or a temperature of the environment of the metering device 10 and to transmit this temperature information to the control unit 15 of the metering device 10 via a signal line 230.

The metering device 10 comprises a memory 39, which is connected to the control unit 15 via the signal line 23*j*. Viscosity information is stored in the memory 39. This viscosity information includes, in particular, information about viscosities of different media 12*a*, 12*b*, 12*c* at different temperatures.

When information about the measured temperature of the medium 12*a* has been transmitted to the control unit 15 by the temperature measuring device 62*a*, the control unit 15 can determine, with recourse to the memory 39, what viscosity the medium 12*a* to be conveyed has at this temperature. The control unit 15 can then check whether there is cause to adjust or change the metering process, for example in such a way that a running time of the pump 16 is increased or reduced in order to supply the desired proper quantity of medium 12*a*, 12*b*, 12*c* to the target apparatus 14.

This procedure takes into account that media of which the viscosity increases with increasing temperature may, for example, require a longer delivery time at higher temperatures. The control unit 15 can take this circumstance into account in the sense of a longer response time of the pump 16.

FIG. 13 also shows that additional or alternative temperature measuring devices 62*b*, 62*c*, 62*d*, each connected via signal lines 23*p*, 23*q*, 23*r*, can also be connected to the control unit 15. Such an arrangement of the temperature measuring devices 62*b*, 62*c*, 62*d* on the containers 11*a*, 11*b*, 11*c* or close to the containers makes sense, for example, if the containers 11*a*, 11*b*, 11*c* for the media 12*a*, 12*b*, 12*c* are located at a distance from the metering device 10, for example in separate rooms.

The exemplary embodiment of FIG. 14 shows another example of the invention, which comprises a temperature measuring device 62 and an assembly unit described with reference to the exemplary embodiments of FIGS. 1 to 12. Here, at least one of the two temperature sensors 25*a*, 25*b*, which is arranged in the assembly unit 30*a*, is configured in such a way that it simultaneously provides the temperature measuring device 62. With the temperature sensors 25*a*, 25*b*, the desired information about a conveyance of medium 12 can be determined and, at the same time, temperature information about the temperature of the medium 12 can be transmitted to the control unit 15.

The invention claimed is:

1. A metering device for metering and supplying media via a fluid line to at least one target apparatus, wherein the metering device is connected to at least one container which is filled with a medium, and wherein the metering device has a control unit which, in order to carry out a metering process with at least one pump, causes a specific volume of the medium to be removed from the container and a conveyance of the volume towards the target apparatus, wherein the fluid line has at least one heating element and at least one temperature sensor connected to a measuring device, wherein the measuring device, with aid of a measurement value output by the temperature sensor, determines information about a performed conveyance of the medium through the fluid line and transmits the information to the control unit, wherein the measuring device has no movable parts arranged in the fluid line.

2. The metering device according to claim 1, wherein the measurement value is based on a measured temperature or change thereof or takes into account a measured temperature or change thereof.

3. The metering device according to claim 1, wherein the fluid line comprises a pair of temperature sensors.

4. The metering device according to claim 3, wherein the two temperature sensors are arranged symmetrically or substantially symmetrically relative to the heating element.

5. The metering device according to claim 3, wherein a first of the temperature sensors is arranged upstream of the heating element and a second of the temperature sensors is arranged downstream of the heating element.

6. The metering device according to claim 3, wherein a comparison of the values output by the two temperature sensors is carried out by the measuring device, wherein the measuring device is configured to determine from the comparison information about an effected conveyance of the medium through the fluid line and to transmit the information to the control unit.

7. The metering device according to claim 1, wherein the heating element and the temperature sensor are combined to form an assembly unit.

8. The metering device according to claim 7, wherein the assembly unit comprises an analogue output or a digital interface for a signal output.

9. The metering device according to claim 7, wherein the assembly unit has a computer unit.

10. The metering device according to claim 9, wherein the computer unit is connected to the control unit.

11. The metering device according to claim 7, wherein a first assembly unit is assigned to the metering device, and at least one second assembly unit is assigned to the target apparatus.

12. The metering device according to claim 11, wherein the first assembly unit and the second assembly unit are connected to the control unit.

13. The metering device according to claim 7, wherein a plurality of target apparatuses are connected to the metering device, and each target apparatus is assigned an assembly unit.

14. The metering device according to claim 7, wherein at least one assembly unit is configured to provide a POD (proof of delivery) signal.

15. The metering device according to claim 1, wherein the heating element is arranged between the pump and the target apparatus.

16. The metering device according to claim 1, wherein the heating element is arranged upstream of the pump.

17. The metering device according to claim 1, wherein at least one heating element is assigned to the target apparatus and/or at least one heating element is assigned to the metering device.

18. The metering device according to claim 1, wherein the heating element and the temperature sensor are built into the metering device and/or are fixedly connected to the metering device.

* * * * *